US010774855B2

(12) United States Patent
Nakayama et al.

(10) Patent No.: US 10,774,855 B2
(45) Date of Patent: Sep. 15, 2020

(54) HYDRAULIC ACTUATOR

(71) Applicant: BRIDGESTONE CORPORATION, Tokyo (JP)

(72) Inventors: Atsushi Nakayama, Higashiyamato (JP); Yasunori Tarutani, Kokubunji (JP); Shingo Ohno, Higashimurayama (JP); Yasuo Fukushima, Kodaira (JP)

(73) Assignee: BRIDGESTONE CORPORATION, Chuo-ku, Tokyo (JP)

( * ) Notice: Subject to any disclaimer, the term of this patent is extended or adjusted under 35 U.S.C. 154(b) by 0 days.

(21) Appl. No.: 16/347,728

(22) PCT Filed: Oct. 30, 2017

(86) PCT No.: PCT/JP2017/039198
§ 371 (c)(1),
(2) Date: May 6, 2019

(87) PCT Pub. No.: WO2018/084122
PCT Pub. Date: May 11, 2018

(65) Prior Publication Data

US 2019/0285095 A1 Sep. 19, 2019

(30) Foreign Application Priority Data

Nov. 7, 2016 (JP) ..... 2016-217526
Jan. 20, 2017 (JP) ..... 2017-008960

(51) Int. Cl.
*F15B 15/10* (2006.01)
*F15B 15/14* (2006.01)
*D03D 3/02* (2006.01)

(52) U.S. Cl.
CPC ..... *F15B 15/1438* (2013.01); *F15B 15/10* (2013.01); *F15B 15/1428* (2013.01);
(Continued)

(58) Field of Classification Search
CPC . F15B 15/10; F15B 15/103; A61H 2201/1238
See application file for complete search history.

(56) References Cited

U.S. PATENT DOCUMENTS 3,645,173 A 2/1972 Yarlott
4,615,260 A * 10/1986 Takagi ..... B25J 9/142 901/22

(Continued)

FOREIGN PATENT DOCUMENTS

CN 2297379 Y 11/1998
CN 101113745 A 1/2008

(Continued)

OTHER PUBLICATIONS

Search Report dated Nov. 29, 2019 in Chinese Application No. 201780068447.4.

(Continued)

*Primary Examiner* — Thomas E Lazo
(74) *Attorney, Agent, or Firm* — Sughrue Mion, PLLC

(57) ABSTRACT

Provided is a hydraulic actuator with improved durability, the hydraulic actuator (10), having an actuator main body (100) constituted of a cylindrical tube (110) capable of expanding/contracting by hydraulic pressure and a cylindrical sleeve (120) formed by cords (121) woven to be disposed in predetermined directions, wherein: the average angle ($\Theta_1$) formed by the cords (121) with respect to the axis direction ($D_{AX}$) of the actuator with no load and no pressure applied thereon is in a range of ≥20° and <45°; and in a state where the average angle ($\Theta_3$) formed by the cords (121) with respect to the axis direction ($D_{AX}$) is 45° under hydraulic pressure of 5 MPa, a ratio (S2/S1) of the total area (S2) of clearances (122) between the cords (121) with respect to an area (S1) of an outer peripheral surface of the actuator main body (100) is 35% or less.

20 Claims, 12 Drawing Sheets

(52) U.S. Cl.
CPC ..... *D03D 3/02* (2013.01); *D10B 2401/06* (2013.01); *D10B 2505/02* (2013.01); *F15B 2215/305* (2013.01)

(56) References Cited

U.S. PATENT DOCUMENTS

| | | | | | |
|---|---|---|---|---|---|
| 4,721,030 | A | | 1/1988 | Paynter | |
| 4,860,639 | A | * | 8/1989 | Sakaguchi | F15B 15/103 92/5 R |
| 5,067,390 | A | * | 11/1991 | Negishi | F15B 15/103 92/117 R |
| 5,079,999 | A | | 1/1992 | Negishi et al. | |
| 5,080,020 | A | * | 1/1992 | Negishi | B61B 13/10 104/138.2 |
| 5,165,323 | A | * | 11/1992 | Sato | F15B 15/103 92/165 R |
| 2007/0158010 | A1 | | 7/2007 | Steinke et al. | |
| 2018/0256434 | A1 | | 9/2018 | Matsuo et al. | |

FOREIGN PATENT DOCUMENTS

| | | | |
|---|---|---|---|
| CN | 101365598 | A | 2/2009 |
| JP | 61-157803 | A | 7/1986 |
| JP | 61-236905 | A | 10/1986 |
| JP | 2-38585 | U | 3/1990 |
| JP | 5-164112 | A | 6/1993 |
| JP | 5-229306 | A | 9/1993 |
| JP | 6-56164 | B2 | 7/1994 |
| JP | 5393212 | B2 | 1/2014 |
| JP | 2014-224569 | A | 12/2014 |
| JP | 2016-156116 | A | 9/2016 |
| JP | 2017-046754 | A | 3/2017 |
| JP | 2017-214966 | A | 12/2017 |

OTHER PUBLICATIONS

International Preliminary Report on Patentability with Written Opinion dated May 7, 2019 for PCT/JP2017/039198.

International Search Report for PCT/JP2017/039198 dated Jan. 23, 2018 [PCT/ISA/210].

Iwata et al., "A Method of Designing and Fabricating Mckibben Muscles Driven by 7MPa Hydraulics", International Journal of Automation Technology, 2012, vol. 6, No. 4, XP055688663, pp. 482-487 (total 6 pages).

Mori et al., "Development of Very High Force Hydraulic McKibben Artificial Muscle and Its Application to Shape-Adaptable Power Hand", Proceedings of the 2009 IEEE International Conference on Robotics and Biomimetics, Dec. 19-23, 2009, XP031641678, pp. 1457-1462 (total 6 pages).

Communication dated May 14, 2020 from European Patent Office in EP Application No. 17867814.0.

* cited by examiner

HYDRAULIC ACTUATOR

CROSS REFERENCE TO RELATED APPLICATIONS

This application is a National Stage of International Application No. PCT/JP2017/039198, filed on Oct. 30, 2017, which claims priority from Japanese Patent Application No. 2016-217526, filed on Nov. 7, 2016, and Japanese Patent Application No. 2017-008960, filed on Jan. 20, 2017.

TECHNICAL FIELD

The present invention relates to a hydraulic actuator.

BACKGROUND ART

Conventionally, there has been widely used as an actuator for expanding/contracting a tube a pneumatic actuator having a rubber tube (a tube-shaped body) capable of expanding/contracting by using air as working fluid and a sleeve (a woven reinforcing structure) covering an outer peripheral surface of the tube, i.e. a McKibben type actuator (refer to PTL1, for example).

Respective end portions of an actuator main body constituted of a tube and a sleeve as described above are caulked by using a sealing member formed by metal.

The sleeve is a cylindrical structure formed by woven high tensile strength fiber cords such as polyamide fibers or metal cords, for regulating expansion movements of the tube within a predetermined range.

Such a pneumatic actuator as described above, which is used in various fields, is suitably used as an artificial muscle for a nursing care/healthcare device in particular.

CITATION LIST

Patent Literature

PTL1: JP S61-236905 A

SUMMARY

Technical Problem

However, such a conventional actuator as described above using air as working fluid does not have particularly high strength (pressure resistance), which strength is only around 0.5 MPa at most, for example.

In this respect, durability of the conventional actuator is not satisfactory when it is employed as a hydraulic actuator using liquid such as oil, water or the like as working fluid because a hydraulic actuator is generally subjected to high pressure, e.g. 5 MPa. In a case where a sleeve is not adequately designed, in particular, in a hydraulic actuator, a tube of the actuator will have to bear yet larger load, further increasing demand for improved durability of the actuator.

In view of this, an object of the present disclosure is to solve the prior art problems described above and provide a hydraulic actuator using liquid as working fluid, which exhibits improved durability.

Solution to Problem

Primary features of the present disclosure for achieving the aforementioned object are as follows.

A hydraulic actuator of the present disclosure has an actuator main body constituted of a cylindrical tube capable of expanding/contracting by hydraulic pressure and a sleeve for covering an outer peripheral surface of the tube, the sleeve having a cylindrical structure formed by cords woven to be disposed in predetermined directions, wherein:

the average angle formed by the cords of the sleeve with respect to the axis direction of the actuator with no load and no pressure applied thereon is in a range of 20° or larger and less than 45°; and in a state where the average angle formed by the cords of the sleeve with respect to the axis direction of the actuator is 45° under hydraulic pressure of 5 MPa, a ratio (S2/S1) of the total area (S2) of clearances between the cords of the sleeve with respect to an area (S1) of an outer peripheral surface of the actuator main body is 35% or less.

The hydraulic actuator of the present disclosure, having the adequately designed sleeve, experiences relatively small load on the tube thereof and thus exhibits improved durability.

In a preferable example of the hydraulic actuator of the present disclosure, the cords which form the sleeve is made of at least one fiber material selected from the group consisting of polyamide fiber, polyester fiber, polyurethane fiber, rayon, acrylic fiber, and polyolefin fiber. In this case, durability of the actuator further improves.

In another preferable example of the hydraulic actuator of the present disclosure, the sleeve is made of one group of cords disposed in one direction and the other group of cords disposed to intersect the cords of the one group, so that the intersecting points at which the cords or pairs of the cords intersect one cord at the upper/lower side thereof in an alternate manner are shifted, by a single cord, from the intersecting points at which the cords or pairs of the cords intersect another cord (adjacent to the one cord) at the upper/lower side thereof in an alternate manner. In this case, durability of the actuator further improves.

In yet another preferable example of the hydraulic actuator of the present disclosure, the sleeve is woven by a twill or plain weave. In this case, durability of the actuator further improves.

In yet another preferable example of the hydraulic actuator of the present disclosure, the cords of the sleeve have breaking strength of at least 200 N/one cord. In this case, durability of the actuator further improves. Breaking strength of the cord is measured according to JIS L1017 in the present disclosure.

In yet another preferable example of the hydraulic actuator of the present disclosure, the cords of the sleeve each have breaking elongation of at least 2.0%. In this case, durability of the actuator further improves. Breaking elongation of the cord is measured according to JIS L1017 in the present disclosure.

In yet another preferable example of the hydraulic actuator of the present disclosure, each of the cords of the sleeve has a diameter in the range of 0.3 mm to 1.5 mm. In this case, durability of the actuator further improves.

In yet another preferable example of the hydraulic actuator of the present disclosure, driving density of the cords in the sleeve is in the range of 6.8 cords/cm to 25.5 cords/cm. In this case, durability of the actuator further improves.

In yet another preferable example of the hydraulic actuator of the present disclosure, provided that "t" (mm) represents thickness of the tube, "d" (mm) represents a diameter of the cord of the sleeve, "$\Theta_1$" represents the average angle formed by the cord of the sleeve with respect to the axis direction of the actuator with no load and no pressure applied thereon, and "$\Theta_2$" represents the average angle formed by the cord of the sleeve with respect to the axis direction of the actuator in an actuator contracting state, t, d, $\Theta_1$ and $\Theta_2$ satisfy general formula (1) shown below.

$$t > \sin\Theta_2 \cdot \frac{\sin(2\Theta_2)}{\sin(2\Theta_1)} \cdot \left(\frac{1}{\sin(2\Theta_1)} - \frac{1}{2\cos\Theta_2}\right) \cdot d \quad (1)$$

In this case, durability of the actuator further improves.

In this respect, the average angle $\Theta_2$ formed by the cord of the sleeve with respect to the axis direction of the actuator in an actuator contracting state is a value measured under the condition of load: 2.5 kN and hydraulic pressure: 5 MPa.

Further, provided that "t" (mm) represents thickness of the tube, "d" (mm) represents a diameter of the cord of the sleeve. "$\Theta_1$" represents the average angle formed by the cord of the sleeve with respect to the axis direction of the actuator with no load and no pressure applied thereon, and "$\Theta_2$" represents the average angle formed by the cord of the sleeve with respect to the axis direction of the actuator in the actuator contracting state, t, d, $\Theta_1$ and $\Theta_2$ more preferably satisfy general formula (2) shown below.

$$t > \frac{\sin(2\Theta_2)\sin(\Theta_2)}{\sin^2(2\Theta_1)} \cdot d \quad (2)$$

In this case, durability of the actuator even further improves.

In yet another preferable example of the hydraulic actuator of the present disclosure, twist coefficient K of the cord of the sleeve, defined by general formula (3) shown below, is in the range of 0.14 to 0.50.

$$K = T_2 \times \sqrt{0.125 \times \frac{D}{\rho}} \times 10^{-3} \quad (3)$$

[In the formula (3), "$T_2$" represents the second twist number (number/10 cm) of the cord, $T_2$ should be replaced with the first twist number $T_1$ (number/10 cm) when the cord is a single twist cord, "D" represents the fineness per one raw yarn (dtex) of the cord, and "ρ" represents the density (g/cm$^3$) of the yarn of the cord.]

In this case, the hydraulic actuator having the adequately designed sleeve is subjected to relatively small load on the tube thereof and thus exhibits further improved durability.

In the hydraulic actuator of the present disclosure, the cord of the sleeve preferably has a ratio ($T_1$/D) of the first twist number $T_1$ (number/10 cm) with respect to the fineness D (dtex) per one raw yarn of the cord in the range of 0.004 to 0.03. In this case, durability of the actuator even further improves.

In the hydraulic actuator of the present disclosure, the cord of the sleeve preferably has a ratio ($T_1$/$T_2$) of the first twist number $T_1$ (number/10 cm) with respect to the second twist number $T_2$ (number/10 cm) in the range of 0.8 to 1.2. In this case, durability of the actuator even further improves.

In the hydraulic actuator of the present disclosure, the fineness D per one raw yarn of the cord of the sleeve is preferably in the range of 800 to 5000 dtex. Further, the cord preferably has the first twist number $T_1$ in the range of 3.2 to 150/10 cm, the second twist number $T_2$ in the range of 2.6 to 180/10 cm, and the number of the twisted yarns constituting the cord in the range of 2 to 4. In this case, durability of the actuator even further improves.

In yet another preferable example of the hydraulic actuator of the present disclosure, thickness of the tube with no load and no pressure applied on the actuator is in the range of 1.0 mm to 6.0 mm. In this case, durability of the actuator even further improves.

Advantageous Effect

According to the present disclosure, it is possible to provide a hydraulic actuator of which durability has improved.

DETAILED DESCRIPTION

Figure 1:
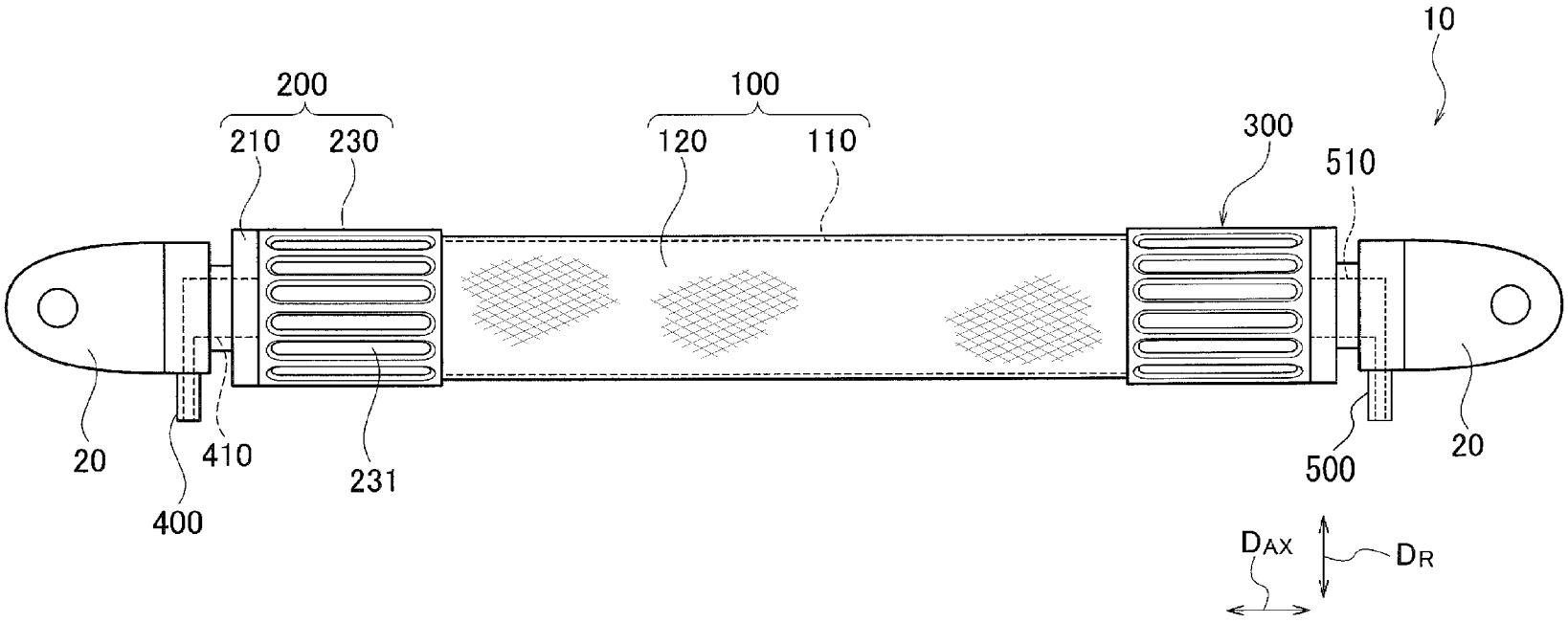
FIG. 1 is a side view of an embodiment of a hydraulic actuator 10.

Hereinafter, the hydraulic actuator of the present disclosure will be demonstratively described in detail based on embodiments thereof and with reference to the drawings. The same functions and structures share the same/similar reference numerals and repetitive or redundant explanations thereof will be omitted.

(1) Outline of Entire Structure of Hydraulic Actuator

FIG. 1 is a side view of a hydraulic actuator 10 according to an embodiment of the present disclosure. As shown in FIG. 1, the hydraulic actuator 10 has an actuator main body 100, a sealing mechanism 200, and another sealing mechanism 300. Respective connection portions 20 are provided at respective ends of the hydraulic actuator 10.

The actuator main body 100 is constituted of a tube 110 and a sleeve 120. A working fluid flows into the actuator main body 100 via a fitting 400 and a passage hole 410. The actuator of the present disclosure is hydraulically operated and uses a liquid as the working fluid. Examples of the liquid include oil, water, and the like. The actuator of the present disclosure may employ either oil pressure or water pressure. In a case where the hydraulic actuator employs oil pressure, any suitable hydraulic oil which is conventionally used in a hydraulic driving system employing oil pressure may be used as hydraulic oil.

The actuator main body 100, when the working fluid flows into the tube 110, contracts in the axis direction $D_{AX}$ and expands in the radial direction $D_R$ of the actuator main body 100. On the other hand, the actuator main body 100, when the working fluid flows out of the tube 110, expands in the axis direction $D_{AX}$ and contracts in the radial direction $D_R$ of the actuator main body 100. The hydraulic actuator 10 functions as an actuator by such changes in configuration of the actuator main body 100 as described above.

Further, the hydraulic actuator 10 as described above is what is called a. McKibben type actuator, which is applicable to artificial muscles of course and can also be suitably used for limbs (upper limbs and lower limbs) of a robot, which limbs require higher capacity (contraction force) than artificial muscles. The connection portions 20 are connected to members constituting the limbs, or the like.

The sealing mechanism 200 and the sealing mechanism 300 seal end portions of the actuator main body 100 in the axis direction $D_{AX}$ thereof, respectively. Specifically, the sealing mechanism 200 includes a sealing member 210 and a caulking member 230. The sealing member 210 seals an end portion in the axis direction $D_{AX}$ of the actuator main body 100. The caulking member 230 caulks the actuator main body 100 in collaboration with the sealing member 210. Indentations 231 as marks made by the caulking jigs are formed at an outer peripheral surface of the caulking member 230.

Differences between the sealing mechanism 200 and the sealing mechanism 300 reside in how the fitting 400 and a fitting 500 (and the passage hole 410 and a passage hole 510) function, respectively.

The fitting 400 provided in the sealing mechanism 200 protrudes such that the fitting 400 can be mounted to a driving pressure source of the hydraulic actuator 10, or more specifically a hose (a piping path) connected to a compressor of the working fluid. The working fluid which has flowed into the actuator via the fitting 400 then flows into the inside of the actuator main body 100, or more specifically the inside of the tube 110, via the passage hole 410.

On the other hand, the fitting 500 provided in the sealing mechanism 300 protrudes such that it can be used for gas venting when the working fluid is injected into the actuator. When the working fluid is injected into the actuator at the initial operation stage of the actuator, gas present inside the actuator is discharged from the fitting 500 via the passage hole 510.

Figure 2:
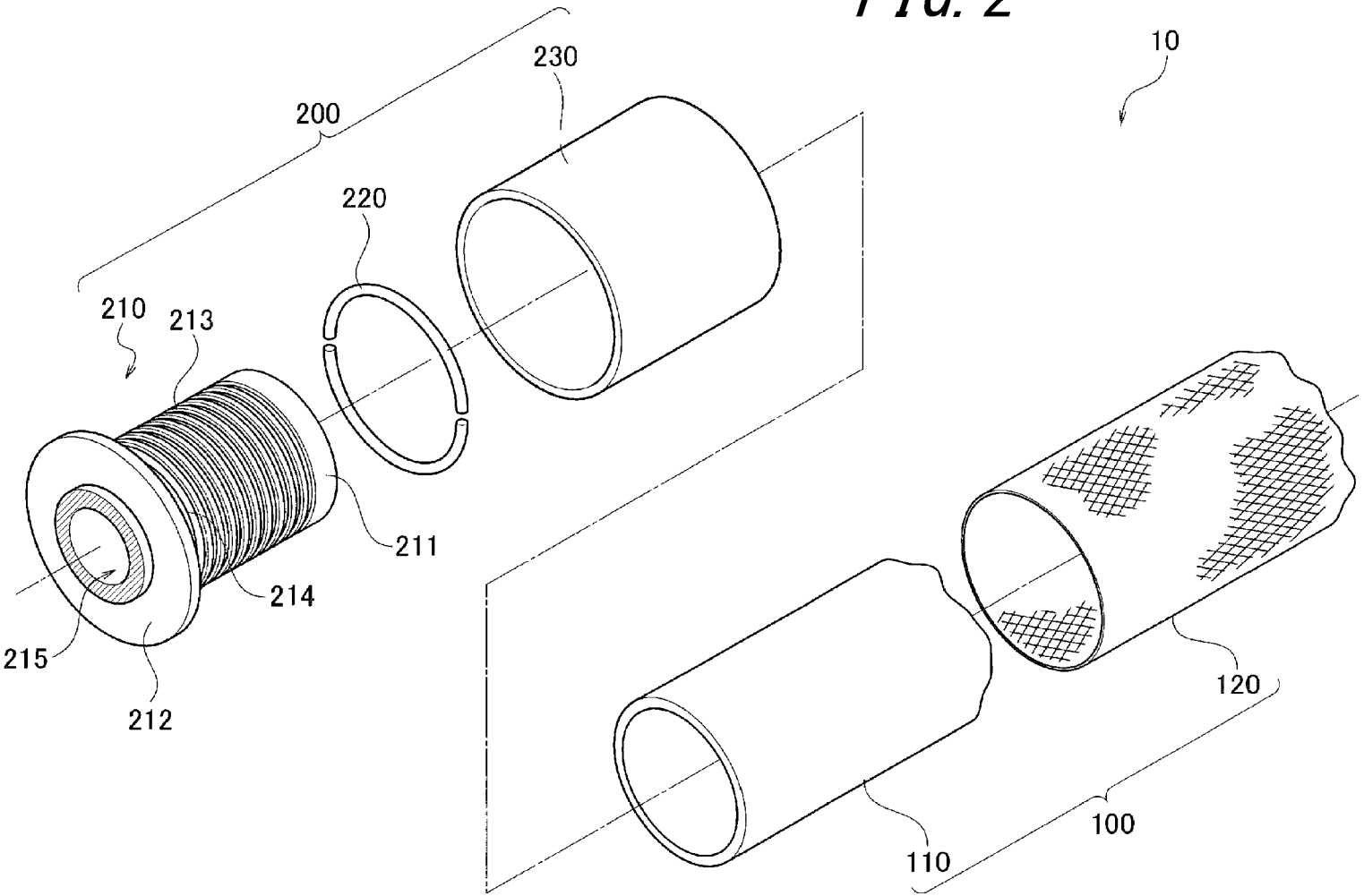
FIG. 2 is a partially exploded perspective view of an embodiment of the hydraulic actuator 10.

FIG. 2 is a partially exploded perspective view of the hydraulic actuator 10. As shown in FIG. 2, the hydraulic actuator 10 has the actuator main body 100 and the sealing mechanism 200.

The actuator main body 100 is constituted of the tube 110 and the sleeve 120, as described above.

The tube 110 is a cylindrical, pipe-like member capable of expanding/contracting by hydraulic pressure. The tube 110, which is to repeat contracting and expanding movements alternately by the working fluid, is made of an elastic material such as rubber.

Thickness of the tube 110 with no load and no pressure applied thereon is preferably in the range of 1.0 mm to 6.0 mm and more preferably in the range of 1.4 mm to 5.0 mm. Thickness of the tube 110≥1.0 mm improves strength of the tube 110 and suppresses protrusion of the tube 110 from clearances between the cords of the sleeve 120, thereby further improving durability of the actuator. Thickness of the tube 110≤6.0 mm ensures a satisfactorily high contraction rate and thus a satisfactorily large magnitude of contraction/expansion of the tube 110.

Although the tube 110 shown in FIGS. 1 and 2 has a single-layer structure, it is acceptable in the present disclosure that the tube has a multi-layer structure. Further, the (outer) diameter of the tube 110 may be set appropriately in accordance with the intended application.

The sleeve 120 has a cylindrical configuration and covers an outer peripheral surface of the tube 110. The sleeve 120 has a woven structure formed by weaving cords to be disposed in certain directions, wherein the cords thus disposed intersect each other in a woven manner to provide rhombus configurations in a repetitive and continuous manner. The sleeve 120 having such a configuration as described above can deform like a pantograph and follow contraction/expansion of the tube 110, while also regulating the contraction/expansion.

Figure 3A:
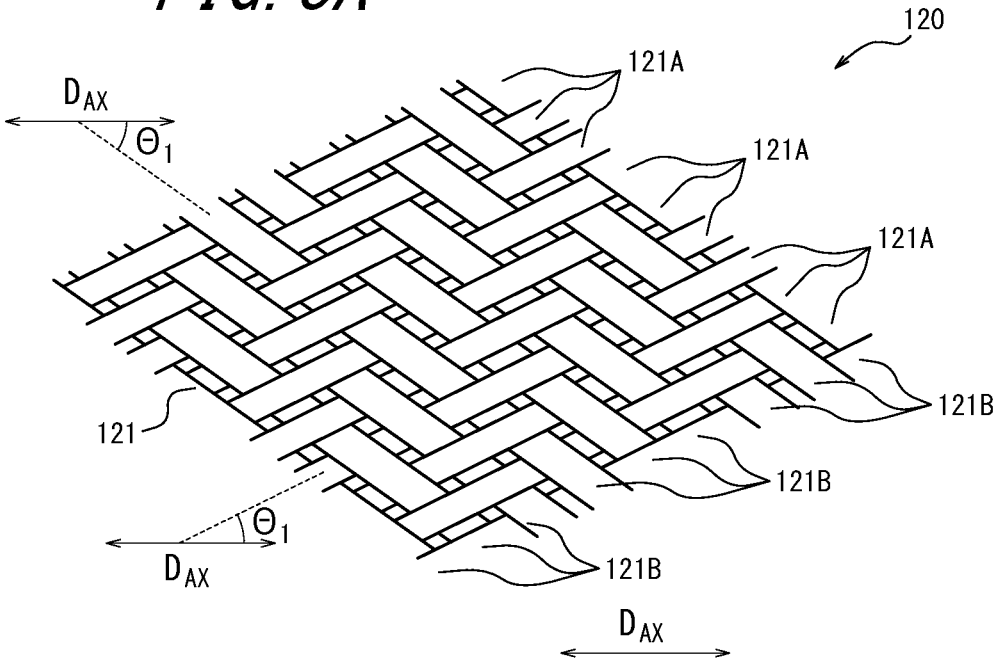
FIG. 3A is a partial side view of an embodiment of a sleeve 120 and FIG. 3B is a partial side view of another embodiment of the sleeve 120 each in a state of no load and no pressure applied on the actuator.
Figure 3B:
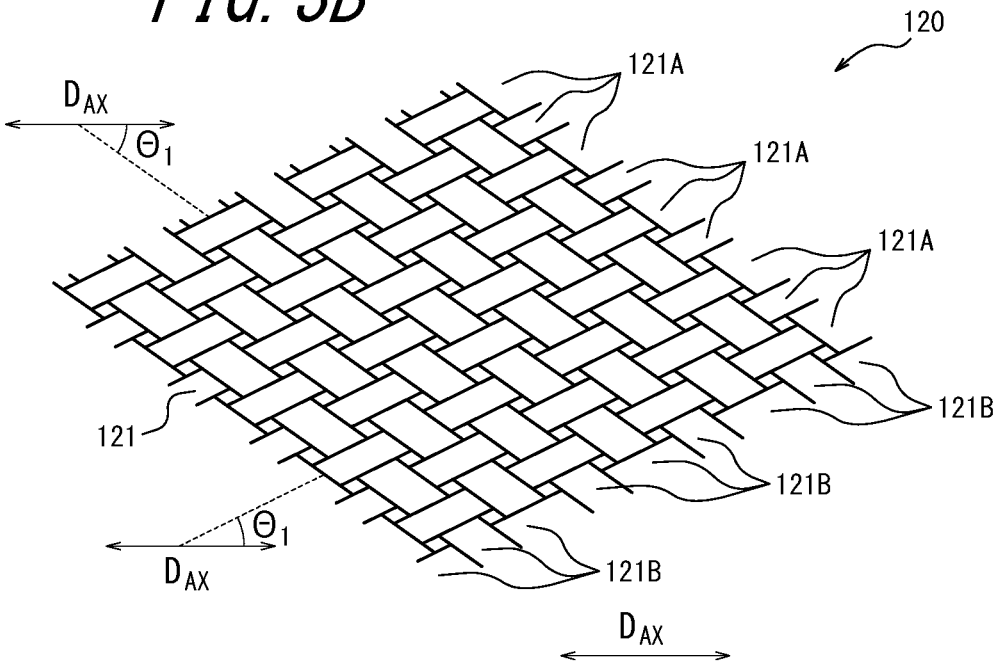

FIG. 3A is a partial side view of an embodiment of the sleeve 120 and FIG. 3B is a partial side view of another embodiment of the sleeve 120 each in a state of no load and no pressure applied on the actuator.

In the present disclosure, the average angle $\Theta_1$ formed by the cords 121 of the sleeve 120 with respect to the axis direction $D_{AX}$ of the actuator with no load and no pressure applied thereon (i.e. at the initial state thereof) is in a range of 20° or larger and less than 45°, as shown in FIG. 3A and FIG. 3B. Setting the average angle $\Theta_1$ formed by the cords 121 of the sleeve 120 with respect to the axis direction $D_{AX}$ of the actuator in a state of no load and no pressure applied thereon, to be 20° or larger, enhances durability of the sleeve 120. If the average angle $\Theta_1$ formed by the cords 121 of the sleeve 120 with respect to the axis direction $D_{AX}$ of the actuator in a state of no load and no pressure applied thereon exceeds 45°, the actuator fails to exhibit a satisfactorily high contraction when it operates, thereby failing to function in a satisfactory manner as an actuator.

The average angle $\Theta_1$ is preferably 22° or larger and more preferably 23° or larger. The larger average angle $\Theta_1$ results in the smaller load born by the tube 110, thereby suppressing breakage of the tube 110 at portions thereof not in direct contact with the cords 121 and thus successfully maintaining satisfactory capacity of the actuator over a long period of time.

The average angle $\Theta_1$ is preferably equal to 37° or less. The average angle $\Theta_1 \leq 37°$ ensures a satisfactorily high contraction rate and thus a satisfactorily large magnitude of contraction/expansion of the tube 110.

The average angle $\Theta_1$ formed by the cords 121 of the sleeve 120 with respect to the axis direction $D_{AX}$ of the actuator in the initial state can be adjusted by, for example, adjusting the direction of the cords 121 when the sleeve 120 is woven and when the sleeve 120 thus woven is formed into a cylindrical shape.

Figure 4A:
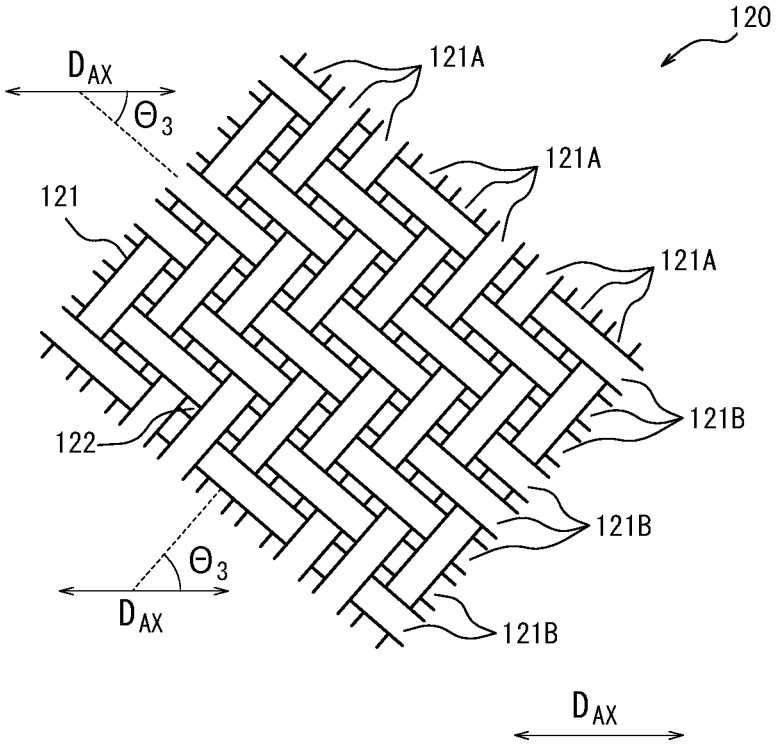
FIG. 4A is a partial side view of an embodiment of the sleeve 120 and FIG. 4B is a partial side view of another embodiment of the sleeve 120, each in a state where the average angle formed by the cords 121 of the sleeve 120 with respect to the axis direction of the actuator is 45°.
Figure 4B:
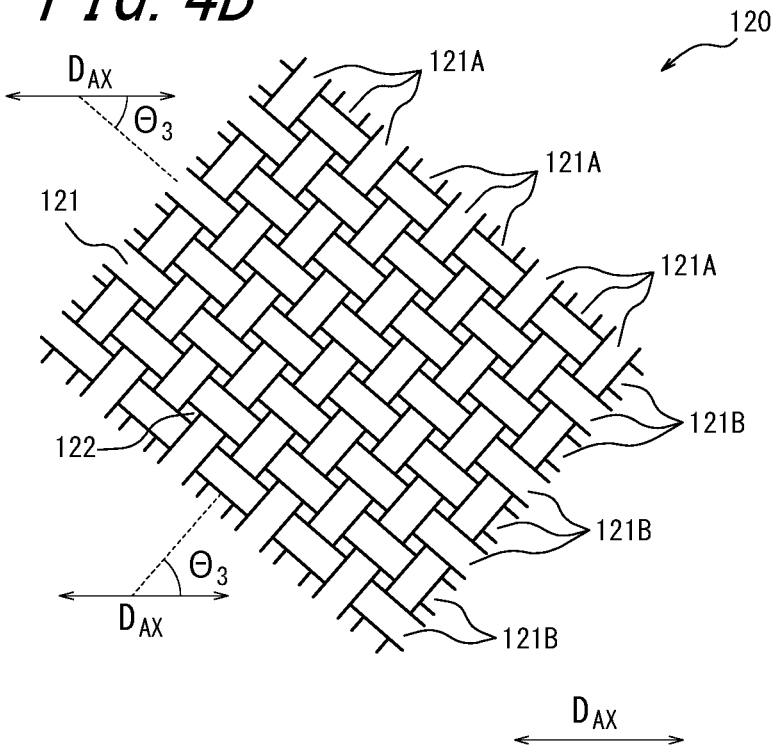

FIG. 4A is a partial side view of an embodiment of the sleeve 120 and FIG. 4B is a partial side view of another embodiment of the sleeve 120, each in a state where the average angle formed by the cords 121 of the sleeve 120 with respect to the axis direction $D_{AX}$ of the actuator is 45°. In the present disclosure, ±1° is allowed as a margin of error when angles of the cords 121 are measured.

In the present disclosure, in a state where the average angle $\Theta_3$ formed by the cords 121 of the sleeve 120 with respect to the axis direction $D_{AX}$ of the actuator is 45° under hydraulic pressure of 5 MPa, a ratio (S2/S1) of the total area (S2) of clearances 122 between the cords 121 of the sleeve 120 with respect to an area (S1) of an outer peripheral surface of the actuator main body 100 is 35% or less, preferably 32% or less, more preferably 30% or less, further more preferably 25% or less, and particularly preferably 20% or less, as shown in FIG. 4A and FIG. 4B. When the ratio (S2/S1) of the total area (S2) of clearances 122 between the cords 121 of the sleeve 120 with respect to an area (S1) of an outer peripheral surface of the actuator main body 100 is 35% or less in a state where the average angle $\Theta_3$ formed by the cords 121 of the sleeve 120 with respect to the axis direction $D_{AX}$ of the actuator is 45°, i.e. in a state where the cords 121 intersect each other at the average intersecting angle of 90°, the tube 110 bears relatively small load and durability of the actuator improves. The lower limit value of the ratio (S2/S1) is not particularly restricted but preferably 5% or higher in terms of achieving a satisfactorily large magnitude of contraction/expansion of the actuator.

The total area (S2) of clearances 122 between the cords 121 of the sleeve 120 can be adjusted by changing type of weaving the sleeve 120, and diameter, material, density of the cords 121 provided in the sleeve 120.

In the present disclosure, the total area (S2) of clearances 122 between the cords 121 of the sleeve 120 is measured after the load applied on the actuator has been adjusted such that the average angle $\Theta_3$ formed by the cords 121 of the sleeve 120 with respect to the axis direction $D_{AX}$ of the actuator is 45° under hydraulic pressure of 5 MPa. In this respect, the total area (S2) is measured or evaluated in a region, of the sleeve 120, where the diameter of the sleeve 120 contracts by −5% with respect to the maximum diameter thereof when the actuator contracts. The sum of the areas of clearances 122 in the region is then regarded as S2 and the area of an outer surface of the actuator main body 100 in the region is regarded as S1, so that the ratio (S2/S1) is calculated. In the present disclosure, the areas of clearances 122 between the cords 121 of the sleeve 120 correspond to the areas where the cord 121 is not present and the tube 110 existing on the inner side of the cords is exposed when the sleeve is viewed from the exterior side.

Further, in the present disclosure, the average angles $\Theta_1$, $\Theta_2$, $\Theta_3$ formed by the cords 121 with respect to the axis direction $D_{AX}$ of the actuator represent acute angles of the angles formed by the cords 121 with respect to the axis direction $D_{AX}$ of the actuator, respectively.

It is preferable to use, as the cord 121 of the sleeve 120, a fiber cord made of at least one fiber material selected from the group consisting of: polyamide fibers such as aramid fiber (aromatic polyamide fiber), polyhexamethylene adipamide (Nylon 6, 6) fiber, polycaprolactam (Nylon 6) fiber and the like; polyester fiber such as polyethylene terephthalate (PET) fiber, polyethylene naphthalate (PEN) fiber and the like; polyurethane fiber; rayon; acrylic fiber; and polyolefin fiber. In this case, durability of the sleeve further improves. It is particularly preferable to use a cord made of aramid fiber in terms of ensuring satisfactory strength of the sleeve 120.

However, the cord 121 is not restricted to such fiber cords as described above. It is acceptable, for example, to use as the cord 121 a cord made of high strength fiber such as PBO (poly para-phenylene benzobisoxazole) fiber or a metal cord made of ultra-fine filaments.

Surfaces of the fiber/metal cords described above may be covered with rubber, mixture of a thermosetting resin and latex, or the like. In a case where surfaces of the cords are covered with these materials, it is possible to decrease a friction coefficient of the surfaces of the cords to an adequate level, while improving durability of the cords.

A solid content in the mixture of a thermosetting resin and latex is preferably in the range of ≥15 mass % and ≤50 mass % and more preferably in the range of ≥20 mass % and ≤40 mass %. Examples of the thermosetting resin include phenol resin, resorcin resin, urethane resin, and the like. Examples of the latex include vinyl pyridine (VP) latex, styrene-butadiene rubber (SBR) latex, acrylonitrile-butadiene rubber (NBR) latex, and the like.

In the present disclosure, it is preferable that the sleeve 120 is, as shown in FIGS. 3A and 4A, made of one group of cords 121A disposed in one direction and the other group of cords 121B disposed to intersect the one group of cords 121A, so that pairs of the two intersecting points at which pairs of the cords 121 intersect one cord 121 at the upper/lower side thereof in an alternate manner are shifted by a single cord 121, in terms of the intersecting points, from pairs of the two intersecting points at which pairs of the cords 121 intersect another cord 121 (adjacent to the one cord 121) at the upper/lower side thereof in an alternate manner. That is, it is preferable that the sleeve 120 is woven by a twill weave. In this case, the tube 110 of the actuator bears yet smaller load and thus the actuator exhibits further improved durability.

Further, in the present disclosure, it is also preferable that the sleeve 120 is, as shown in FIGS. 3B and 4B, made of one group of cords 121A disposed in one direction and the other group of cords 121B disposed to intersect the one group of cords 121A, so that the intersecting points at which the cords 121 intersect one cord 121 at the upper/lower side thereof in an alternate manner are shifted, by a single cord 121, from the intersecting points at which the cords 121 intersect another cord 121 (adjacent to the one cord 121) at the upper/lower side thereof in an alternate manner. That is, it is also preferable that the sleeve 120 is woven by a plain weave. The tube 110 of the actuator bears yet smaller load and thus the actuator exhibits further improved durability in this case, as well.

Yet further, in the present disclosure, it is also preferable that the sleeve 120 is made of the cords 121 woven by a basket weave. The tube 110 of the actuator bears yet smaller load and thus the actuator exhibits further improved durability in this case, as well. The number of the cords to be aligned in the basket weave is not particularly limited. In the present disclosure, it is preferable that one pair of two cords is aligned and then another pair of two cords aligned separately is driven into the one pair of the two cords.

In the present disclosure, the cords 121 of the sleeve 120 have breaking strength of preferably at least 200 N/one cord, more preferably in the range of ≥250 N/one cord and ≤1000 N/one cord, further more preferably in the range of ≥300 N/one cord and ≤1000 N/one cord, yet further more preferably in the range of ≥500 N/one cord and ≤1000 N/one cord, and most preferably in the range of ≥600 N/one cord and ≤1000 N/one cord. In this case, the tube 110 of the actuator bears yet smaller load and thus the actuator exhibits further improved durability.

In the present disclosure, the cords 121 of the sleeve 120 each have breaking elongation of preferably at least 2.0%, more preferably in the range of ≥3.0% and ≤6.0%. In this case, the tube 110 of the actuator bears yet smaller load and thus the actuator exhibits further improved durability.

In the present disclosure, each of the cords 121 of the sleeve 120 has a diameter preferably in the range of 0.3 mm to 1.5 mm, more preferably in the range of 0.4 mm to 1.5 mm, further more preferably in the range of 0.5 mm to 1.5 mm, yet further more preferably in the range of 0.6 mm to 1.3 mm, and most preferably in the range of 0.6 mm to 1.0 mm. In this case, the tube 110 of the actuator bears yet smaller load and thus the actuator exhibits further improved durability.

In the present disclosure, driving density of the cords 121 in the sleeve 120 is preferably in the range of 6.8 cords/cm to 25.5 cords/cm, more preferably in the range of 10.0 cords/cm to 23.5 cords/cm, and further more preferably in the range of 10.0 cords/cm to 20.0 cords/cm. In this case, the tube 110 of the actuator bears yet smaller load and thus the actuator exhibits further improved durability.

In the present disclosure, provided that "t" (mm) represents thickness of the tube 110, "d" (mm) represents a diameter of the cord 121 of the sleeve 120, "$\Theta_1$" represents the average angle formed by the cord 121 of the sleeve 120 with respect to the axis direction $D_{AX}$ of the actuator with no load and no pressure applied thereon, and "$\Theta_2$" represents the average angle formed by the cord 121 of the sleeve 120 with respect to the axis direction $D_{AX}$ of the actuator in an actuator contracting state, it is preferable that t, d, $\Theta_1$ and $\eta_2$ satisfy general formula (1) shown below.

$$t > \sin\Theta_2 \cdot \frac{\sin(2\Theta_2)}{\sin(2\Theta_1)} \cdot \left(\frac{1}{\sin(2\Theta_1)} - \frac{1}{2\cos\Theta_2}\right) \cdot d \tag{1}$$

When t, d, $\Theta_1$ and $\Theta_2$ satisfy general formula (1), the tube 110 of the actuator bears yet smaller load and thus the actuator exhibits further improved durability.

Further, provided that "t" (mm) represents thickness of the tube 110, "d" (mm) represents a diameter of the cord 121 of the sleeve 120, "$\Theta_1$" represents the average angle formed by the cord 121 of the sleeve 120 with respect to the axis direction $D_{AX}$ of the actuator with no load and no pressure applied thereon, and "$\Theta_2$" represents the average angle formed by the cord 121 of the sleeve 120 with respect to the axis direction $D_{AX}$ of the actuator in the actuator contracting state, it is more preferable that t, d, $\Theta_1$ and $\Theta_2$ satisfy general formula (2) shown below.

$$t > \frac{\sin(2\Theta_2)\sin(\Theta_2)}{\sin^2(2\Theta_1)} \cdot d \tag{2}$$

When t, d, $\Theta_1$ and $\Theta_2$ satisfy general formula (2), the tube 110 of the actuator bears yet smaller load and thus the actuator exhibits further improved durability.

In present disclosure, twist coefficient K of the cord 121 of the sleeve 120, defined by general formula (3) shown below, is preferably in the range of 0.14 to 0.50, more preferably in the range of 0.16 to 0.50.

$$K = T_2 \times \sqrt{0.125 \times \frac{D}{\rho}} \times 10^{-3} \tag{3}$$

[In the formula (3), "$T_2$" represents the second twist number (number/1.0 cm) of the cord, $T_2$ should be replaced with the first twist number $T_1$ (number/10 cm) when the cord is a single twist cord, "D" represents the fineness per one raw yarn (dtex) of the cord, and "ρ" represents the density (g/cm$^3$) of the yarn of the cord.]

When the twist coefficient K of the cord 121 of the sleeve 120 is equal to 0.14 or larger, the fibers of the actuator bear relatively small load and thus the actuator exhibits further improved durability. When the twist coefficient K of the cord 121 of the sleeve 120 is equal to 0.50 or less, the tube of the actuator bears relatively small load and thus the actuator exhibits further improved durability.

In this respect, the twist coefficient K of the cord 121 can be adjusted by changing density and/or fineness of the yarn to be used, the first twist number when the cord is manufactured, and the like.

In the present disclosure, the cord 121 of the sleeve 120 has a ratio ($T_1$/D) of the first twist number $T_1$ (number/10 cm) with respect to the fineness D (dtex) per one raw yarn of the cord 121 preferably in the range of 0.004 to 0.03, more preferably in the range of 0.004 to 0.02. In this case, the tube 110 of the actuator bears yet smaller load and thus the actuator exhibits further improved durability.

In the present disclosure, the cord 121 of the sleeve 120 has a ratio ($T^1/T_2$) of the first twist number $T_1$ (number/10 cm) with respect to the second twist number $T_2$ (number/10 cm) preferably in the range of 0.8 to 1.2, more preferably in the range of 0.9 to 1.1. In this case, the tube 110 of the actuator bears yet smaller load and thus the actuator exhibits further improved durability.

In the present disclosure, the fineness D per one raw yarn of the cord 121 of the sleeve 120 is preferably in the range of 800 to 5000 dtex, more preferably in the range of 800 to 4000 dtex, further more preferably in the range of 1000 to 4000 dtex, yet further more preferably in the range of 1500 to 4000 dtex, and most preferably in the range of 2000 to 4000 dtex. In this case, the tube 110 of the actuator bears yet smaller load and thus the actuator exhibits further improved durability.

In the present disclosure, the cord 121 of the sleeve 120 has the first twist number $T_1$ preferably in the range of 3.2 to 150/10 cm, more preferably in the range of 10 to 36/10 cm, and further more preferably in the range of 10 to 30/10 cm. In this case, the tube 110 of the actuator bears yet smaller load and thus the actuator exhibits further improved durability.

In the present disclosure, the cord 121 of the sleeve 120 has the second twist number $T_2$ preferably in the range of 2.6 to 180/10 cm, more preferably in the range of 10 to 36/10 cm, and further more preferably in the range of 10 to 30/10 cm. In this case, the tube 110 of the actuator bears yet smaller load and thus the actuator exhibits further improved durability.

In the present disclosure, the number of the twisted yarns constituting the cord 121 of the sleeve 120 is preferably in the range of 2 to 4 and particularly preferably 2. In this case, the tube 110 of the actuator bears yet smaller load and thus the actuator exhibits further improved durability.

In the present disclosure, the fineness D per one raw yarn of the cord 121 of the sleeve 120 is preferably in the range of 800 to 5000 dtex. Further, the cord 121 has the first twist number $T_1$ preferably in the range of 3.2 to 150/10 cm, the second twist number $T_2$ preferably in the range of 2.6 to 180/10 cm, and the number of the twisted yarns constituting the cord preferably in the range of 2 to 4. When the fineness D per one raw yarn, the first twist number $T_1$, the second twist number $T_2$, and the number of the twisted yarns constituting each cord, of the cord 121 of the sleeve 120, are unanimously within the aforementioned preferable ranges, the tube 110 of the actuator bears yet smaller load and thus the actuator exhibits significantly improved durability.

A method for manufacturing the cord 121 is not particularly restricted. For example, in a case where the cord 121 has what is called a double twist structure in which a plurality of yarns (preferably 2 to 4 yarns) are twisted, the cord can be manufactured, for example, by subjecting each yarn to first twist, aligning a plurality of the yarns thus twisted, and subjecting the yarns thus aligned to second twist in the direction opposite to the first twist, thereby obtaining a twisted yarn cord.

Alternatively, in a case where the cord 121 has what is called a single twist structure in which the cord is obtained by single twist of yarn(s), the cord can be manufactured, for example, by aligning yarn(s) and then twisting them in one direction, thereby obtaining a twisted yarn cord. In the present disclosure, in a case Where the cord 121 has a single twist structure, the first twist number $T_1$ represents the number of the twist (number/10 cm) of yarn(s) when a twisted yarn cord is manufactured. Further, in a case where the cord 121 has a single twist structure, the second twist number $T_2$ (number/10 cm) in the formula (3) should be replaced with the first twist number $T_1$ (number/10 cm). That is, in a case where the cord 121 has a single twist structure, $T_2$ in the formula (3) represents the number of the twist (number/10 cm) of yarn(s) when a twisted yarn cord is manufacture.

In FIG. 2, the sealing mechanism 200 seals an end portion in the axis direction $D_{AX}$ of the actuator main body 100. The sealing mechanism 200 includes the sealing member 210, a first locking ring 220 and the caulking member 230.

The sealing member 210 has a trunk portion 211 and a flange portion 212. Metal such as stainless steel can be suitably used for the sealing member 210. However, the material for the sealing member 210 is not restricted to metal and a hard plastic material or the like can be used instead of metal.

The trunk portion 211 has a tube-like shape. A passage hole 215 through which the working fluid flows is formed in the trunk portion 211. The passage hole 215 communicates with the passage hole 410 (see FIG. 1). The trunk portion 211 is inserted into the tube 110.

The flange portion 212, which is integral with the trunk portion 211, is positioned further on the side of the axis direction $D_{AX}$ end portion of the hydraulic actuator 10 than the trunk portion 211. The flange portion 212 has a larger outer diameter in the radial direction $D_R$ than the outer diameter of the trunk portion 211. The flange portion 212 is fixedly engaged with the tube 110 having the trunk portion 211 inserted therein and the first locking ring 220.

Irregular portions 213 are formed at an outer peripheral surface of the trunk portion 211. The irregular portions 213 contribute to suppressing slippage of the tube 110 relative to the trunk portion 211 inserted therein. The irregular portions 213 preferably include at least three projecting portions.

Further, a first small diameter portion 214, of which outer diameter is smaller than that of the trunk portion 211, is formed in a portion adjacent to the flange portion 212, of the trunk portion 211. The configuration of the first small diameter portion 214 will be further described with reference to FIGS. 5 to 12.

The first locking ring 220 is fixedly engaged with the sleeve 120. Specifically, the sleeve 120 is folded on the outer side in the radial direction $D_R$ and backward by way of the first locking ring 220 (not shown in FIG. 2. See FIG. 5).

The outer diameter of the first locking ring 220 is larger than that of the trunk portion 211. The first locking ring 220 is fixedly engaged with the sleeve 120 at the position of the first small diameter portion 214 of the trunk portion 211, That is, the first locking ring 220 is fixedly engaged with the sleeve 120 at a position adjacent to the flange portion 212 and on the radial direction $D_R$ outer of the trunk portion 211.

The first locking ring 220 has a configuration split into two portions in the embodiments, so that the first locking ring 220 can be engaged with the first small diameter portion 214 having an outer diameter smaller than that of the trunk portion 211. It should be noted that the configuration of the first locking ring 220 is not restricted to the aforementioned two-split one. The first locking ring 220 may be split into three or more portions and some of the split portions may be pivotably linked with each other.

Any of metal, a hard plastic material or the like, i.e. those similar to the materials for the sealing member 210, can be used as a material for the first locking ring 220.

The caulking member 230 caulks the actuator main body 100 in collaboration with the sealing member 210. Metal such as aluminum alloy, brass, iron or the like can be used as a material for the caulking member 230. Indentations 231 as shown in FIG. 1 are formed at an outer surface of the caulking member 230 as a result of the caulking member's being caulked by the caulking jigs.

(2) Structure of Sealing Mechanism

Next, embodiments of the sealing mechanism 200 will be described with reference to FIGS. 5 to 12.

(2.1) Embodiment 1-1

Figure 5:
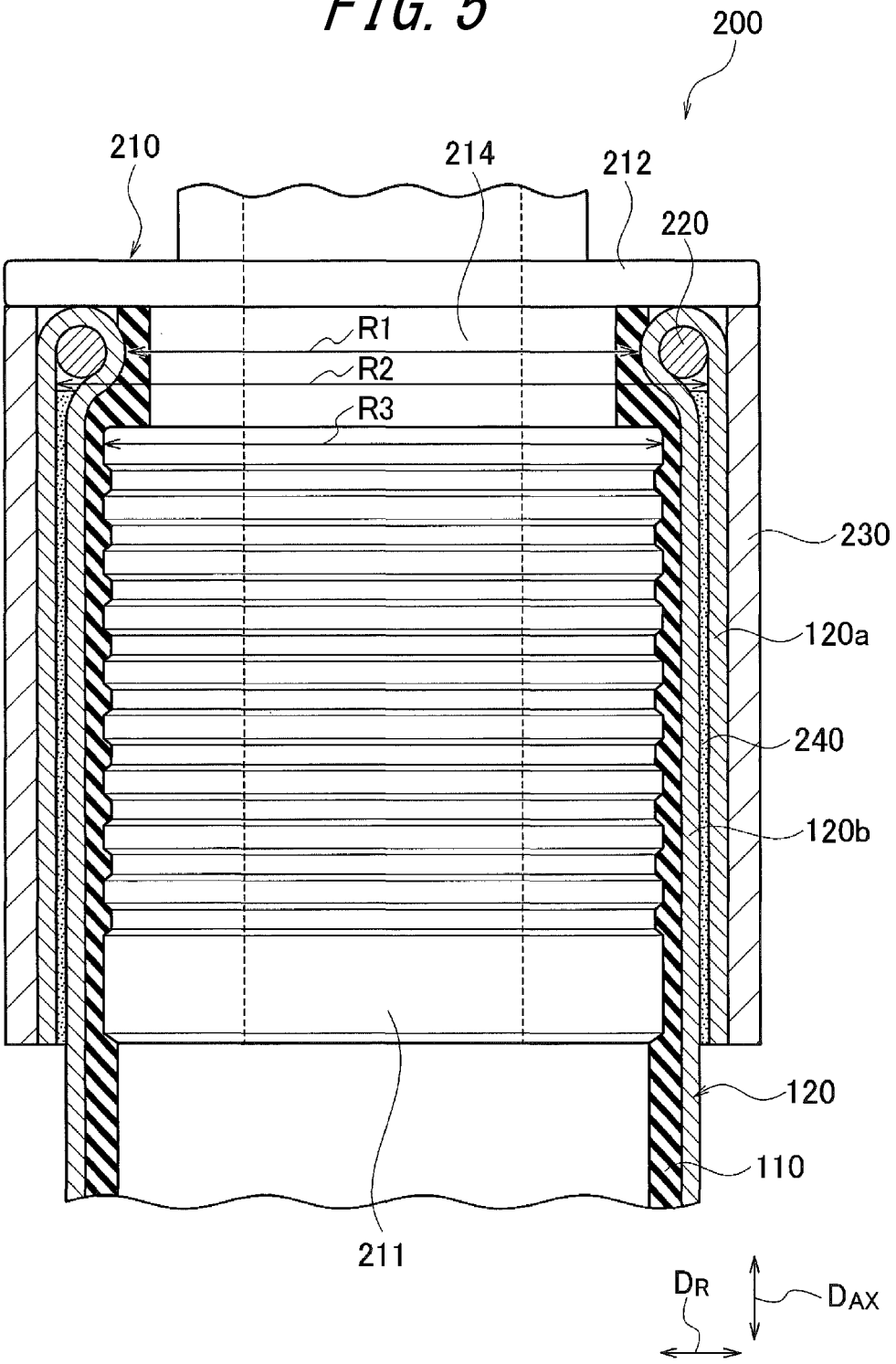
FIG. 5 is a partial sectional view of the hydraulic actuator 10 including a sealing mechanism 200, cut along the axis direction $D_{AX}$ of the hydraulic actuator, according to Embodiment 1-1.

FIG. 5 is a partial sectional view of the hydraulic actuator 10 including a sealing mechanism 200, cut along the axis direction $D_{AX}$ of the hydraulic actuator, according to Embodiment 1-1.

The sealing member 210 has the first small diameter portion 214, of which outer diameter is smaller than that of the trunk portion 211, as described above.

The first locking ring 220 is disposed on the outer side in the radial direction $D_R$ of the first small diameter portion 214. The inner diameter R1 of the first locking ring 220 is smaller than the outer diameter R3 of the trunk portion 211. The outer diameter R2 of the first locking ring 220 may also be smaller than the outer diameter R3 of the trunk portion 211.

The trunk portion 211 is inserted into the tube 110 such that the tube 110 is in contact with the flange portion 212. The sleeve 120, on the other hand, is folded on the outer side in the radial direction $D_R$ and then backward via the first locking ring 220. As a result, the sleeve 120 has a first folded-back portion **120*a*, which has been folded backward by way of the first locking ring 220 at the end in the axis direction $D_{AX}$ of the actuator. Specifically, the sleeve 120 includes: a sleeve main body 120*b* covering the outer peripheral surface of the tube 110; and the first folded-back portion 120*a* folded backward at the end in the axis direction $D_{AX}$ of the sleeve main body 120***b* to be disposed on the outer peripheral side of the sleeve main body 120*b*.

The first folded-back portion 120*a* is attached to the sleeve main body 120*b* situated on the outer side in the radial direction $D_R$ of the tube 110. Specifically, an adhesive layer 240 is formed between the sleeve main body 120*b* and the first folded-back portion 120*a*, so that the sleeve main body 120*b* and the first folded-back portion 120*a* are fixedly attached to each other by the adhesive layer 240. An appropriate adhesive can be used for the adhesive layer 240 in accordance with the type of the cords constituting the sleeve 120.

However, the adhesive layer 240 is not essentially needed in the present disclosure and it is acceptable that the first folded-back portion 120*a* is not fixedly attached to the sleeve main body 120*b*.

The trunk portion 211 of the sealing member 210 is inserted into the caulking member 230 having an inner diameter larger than the outer diameter of the trunk portion 211 and then the caulking member is caulked by the jig members. The caulking member 230 caulks the actuator main body 100 in collaboration with the sealing member 210. Specifically, the caulking member 230 caulks the tube 110 having the trunk portion 211 inserted therein, the sleeve main body 120*b*, and the first folded-back portion 120*a*. That is, the caulking member 230 caulks the tube 110, the sleeve main body 120*b*, and the first folded-back portion 120*a* in collaboration with the sealing member 210.

(2.2) Embodiment 1-2

Figure 6:
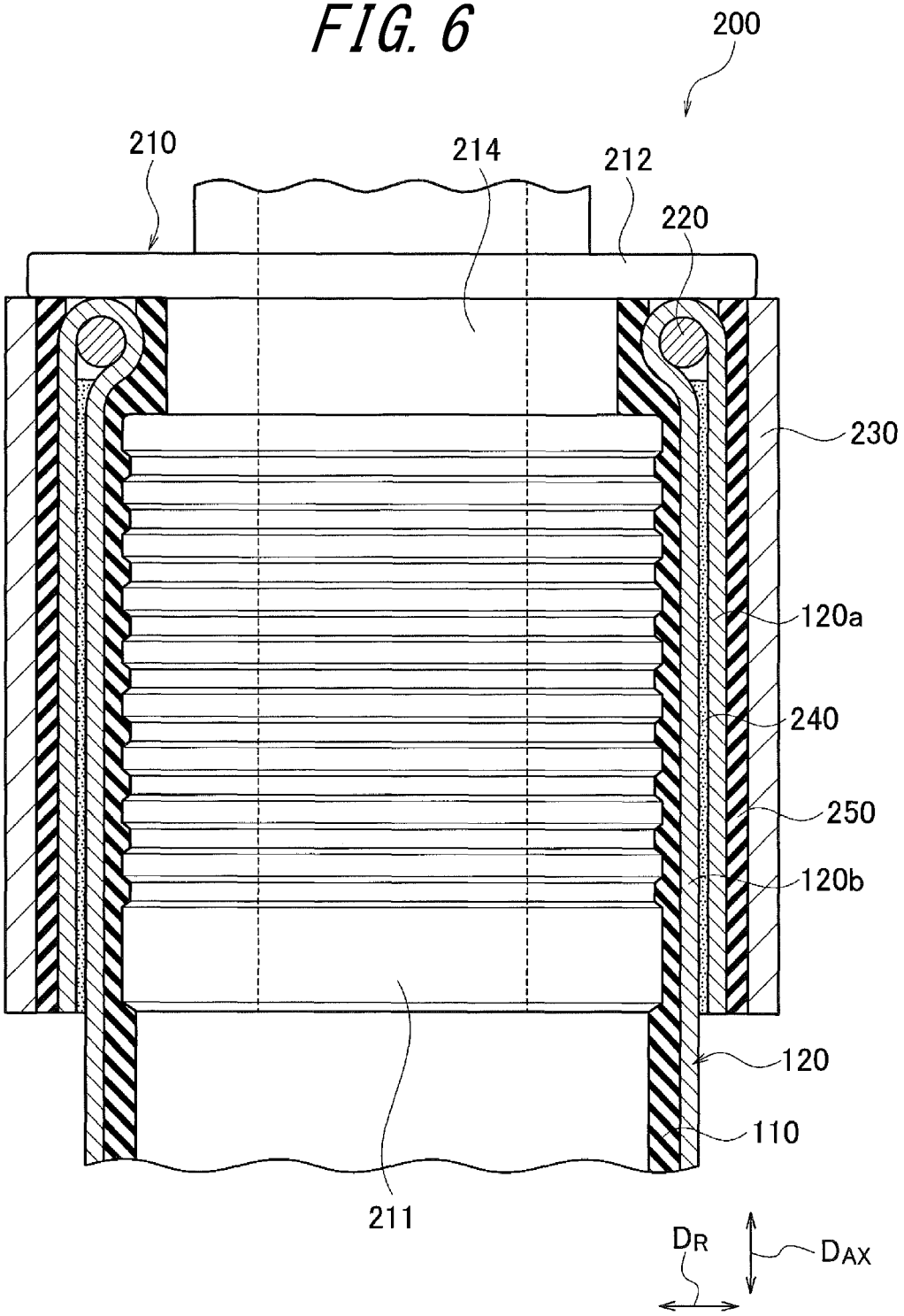
FIG. 6 is a partial sectional view of the hydraulic actuator 10 including a sealing mechanism 200, cut along the axis direction $D_{AX}$ of the hydraulic actuator, according to Embodiment 1-2.

FIG. 6 is a partial sectional view of the hydraulic actuator 10 including a sealing mechanism 200, cut along the axis direction $D_{AX}$ of the hydraulic actuator, according to Embodiment 1-2. Hereinafter, Embodiment 1-2 will be described mainly in regard to differences between Embodiment 1-1 and itself.

In Embodiment 1-2, a sheet-like elastic member is provided between the first folded-back portion 120*a* of the sleeve 120 and the caulking member 230. Specifically, a rubber sheet 250 is provided between the first folded-back portion 120*a* and the caulking member 230. The rubber sheet 250 is provided so as to cover an outer peripheral surface of the cylindrical first folded-back portion 120*a*. The type of rubber sheet 250 is not particularly restricted. A rubber material similar to the rubber of the tube 110 may be used for the rubber sheet 250. The caulking member 230 caulks the actuator main body 100 including the rubber sheet 250 in collaboration with the sealing member 210.

(2.3) Embodiment 1-3

Figure 7:
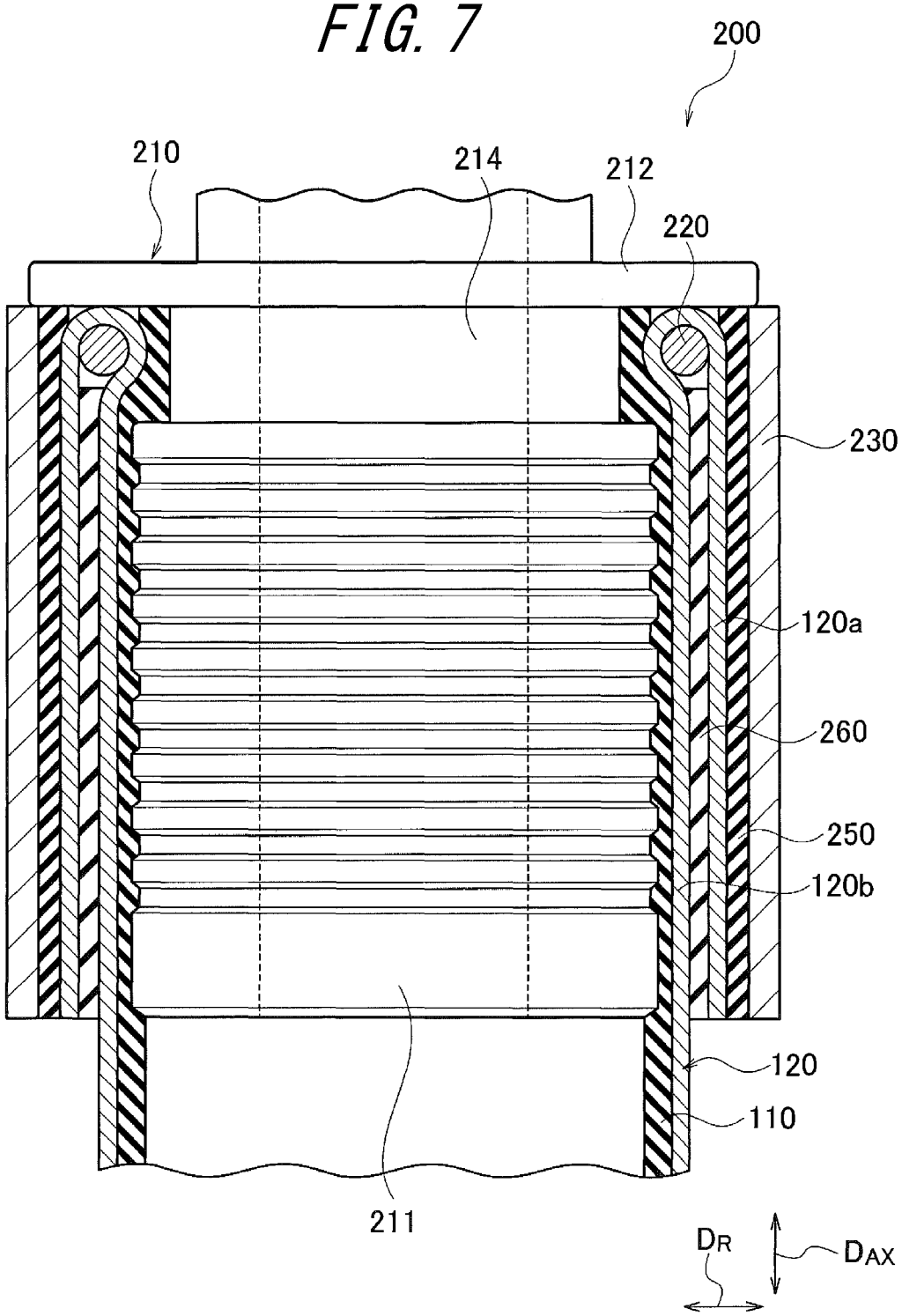
FIG. 7 is a partial sectional view of the hydraulic actuator 10 including a sealing mechanism 200, cut along the axis direction $D_{AX}$ of the hydraulic actuator, according to Embodiment 1-3.

FIG. 7 is a partial sectional view of the hydraulic actuator 10 including a sealing mechanism 200, cut along the axis direction $D_{AX}$ of the hydraulic actuator, according to Embodiment 1-3.

In Embodiment 1-3, a rubber sheet 260 is used in place of the adhesive layer 240 of Embodiment 1-1. The rubber sheet 260 is a sheet-like elastic member and provided between the sleeve main body 120*b* and the first folded-back portion 120*a*. A rubber material similar to the rubber of the rubber sheet 250 may be used for the rubber sheet 260.

(2.4) Embodiment 2-1

Figure 8:
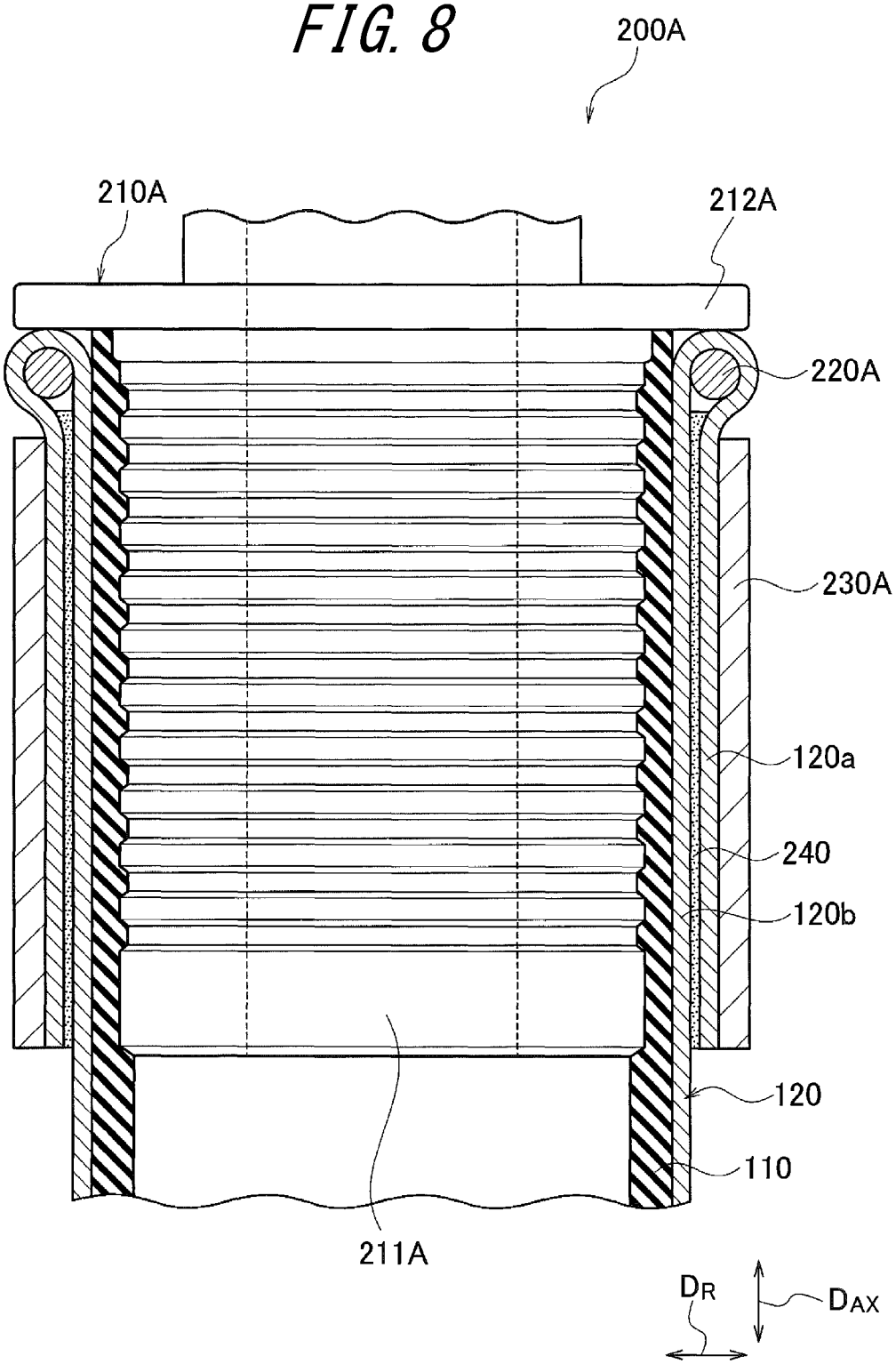
FIG. 8 is a partial sectional view of the hydraulic actuator 10 including a sealing mechanism 200A, cut along the axis direction $D_{AX}$ of the hydraulic actuator, according to Embodiment 2-1.

FIG. 8 is a partial sectional view of the hydraulic actuator 10 including a sealing mechanism 200A, cut along the axis direction $D_{AX}$ of the hydraulic actuator, according to Embodiment 2-1.

In Embodiment 2-1, a sealing mechanism 200A is used in place of the sealing mechanism 200 of Embodiments 1-1, 1-2 and 1-3. The sealing mechanism 200A differs from the sealing mechanism 200 in that the former lacks the first small diameter portion 214 formed in the latter.

The sealing mechanism 200A includes a sealing member 210A, a first locking ring 220A, and a caulking member 230A.

A trunk portion 211A of the sealing member 210A is inserted into the tube 110. Since the sealing member 210A lacks the first small diameter portion 214 provided in the sealing member 210, the diameter of the first locking ring 220A is larger than the outer diameter of the entire trunk portion 211A. Accordingly, the first locking ring 220A is held by the flange portion 212A and the caulking member 230A between the flange portion 212A and the caulking member 230A.

Since the diameter of the first locking ring 220A is larger than the outer diameter of the entire trunk portion 211A, the caulking member 230A is not in contact with the flange portion 212A. That is, the first locking ring 220A is exposed to the exterior at the portion thereof on which the sleeve 120 is folded backward. Further, the first locking ring 220A need not be split like the first locking ring 220 of the embodiments 1-1, 1-2 and 1-3 because the diameter of the first locking ring 220A is safely larger than the outer diameter of the entire trunk portion 211A.

An adhesive layer 240 is formed between the sleeve main body 120*b* and the first folded-back portion 120*a* in the present embodiment, as in Embodiment 1-1.

(2.5) Embodiment 2-2

Figure 9:
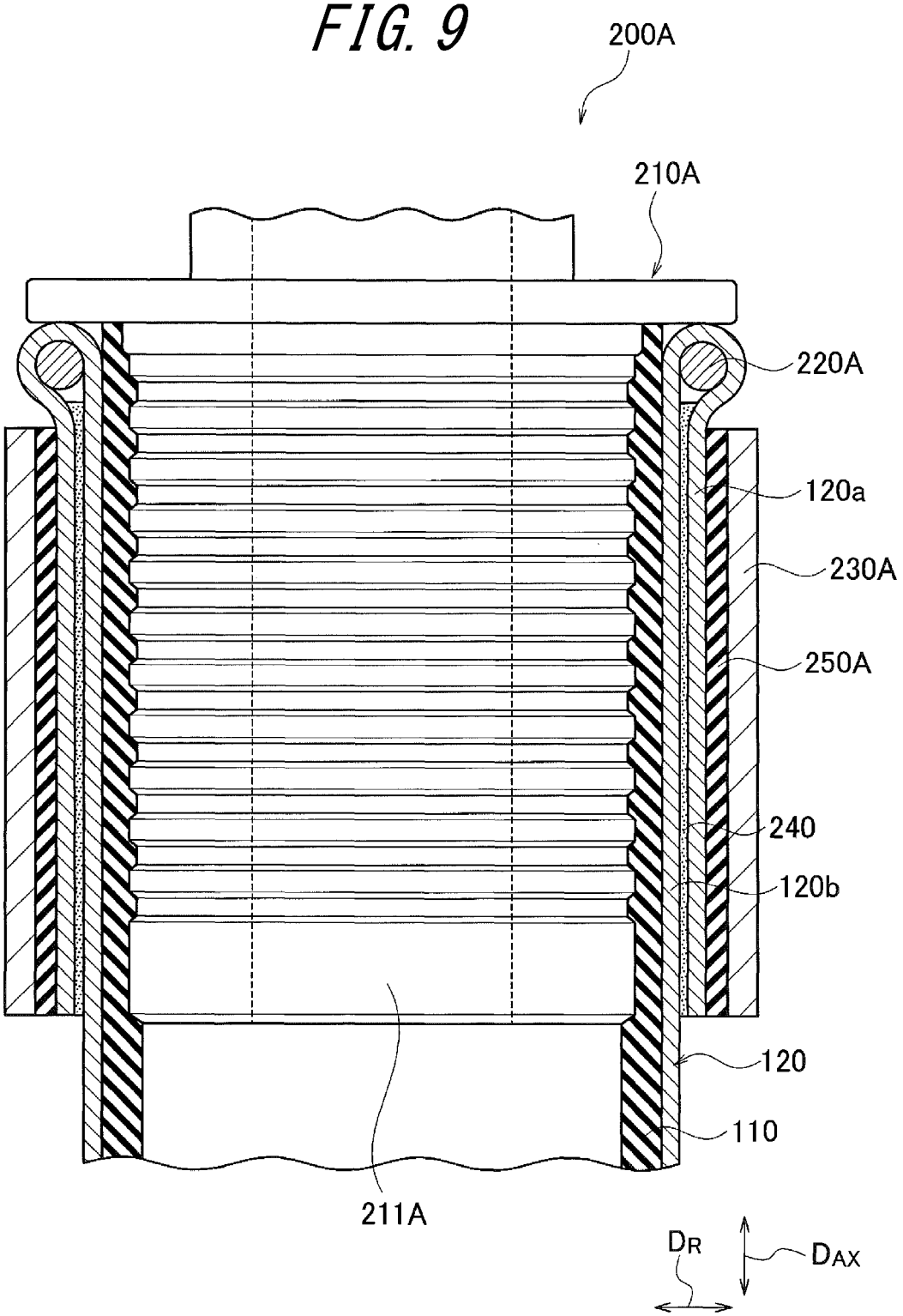
FIG. 9 is a partial sectional view of the hydraulic actuator 10 including a sealing mechanism 200A, cut along the axis direction $D_{AX}$ of the hydraulic actuator, according to Embodiment 2-2.

FIG. 9 is a partial sectional view of the hydraulic actuator 10 including a sealing mechanism 200A, cut along the axis direction $D_{AX}$ of the hydraulic actuator, according to Embodiment 2-2. Hereinafter, Embodiment 2-2 will be described mainly in regard to differences between Embodiment 2-1 and itself.

In Embodiment 2-2, a sheet-like elastic member is provided between the first folded-back portion 120*a* of the sleeve 120 and the caulking member 230A. Specifically, a rubber sheet 250A is provided between the first folded-back portion 120*a* and the caulking member 230A. The rubber sheet 250A is provided so as to cover an outer peripheral surface of the cylindrical first folded-back portion 120*a* as the rubber sheet 250 does in Embodiment 1-2.

(2.6) Embodiment 2-3

Figure 10:
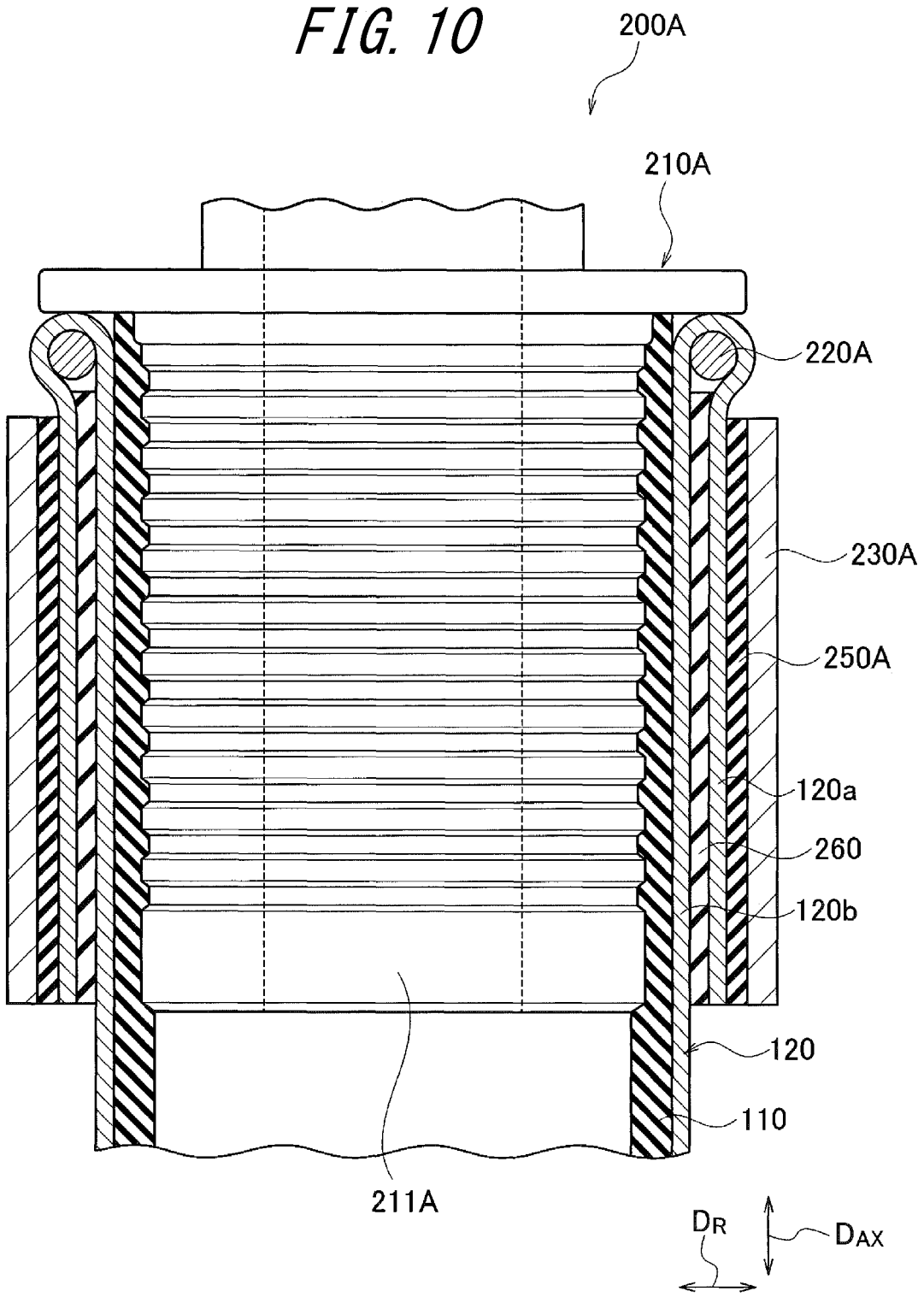
FIG. 10 is a partial sectional view of the hydraulic actuator 10 including a sealing mechanism 200A, cut along the axis direction $D_{AX}$ of the hydraulic actuator, according to Embodiment 2-3.

FIG. 10 is a partial sectional view of the hydraulic actuator 10 including a sealing mechanism 200A, cut along the axis direction $D_{AX}$ of the hydraulic actuator, according to Embodiment 2-3.

In Embodiment 2-3, a rubber sheet 260 is used in place of the adhesive layer 240 of Embodiment 2-1. The rubber sheet 260 is a sheet-like elastic member and provided between the sleeve main body 120*b* and the first folded-back portion 120*a*, as in Embodiment 1-3.

(2.7) Embodiment 3-1

Figure 11:
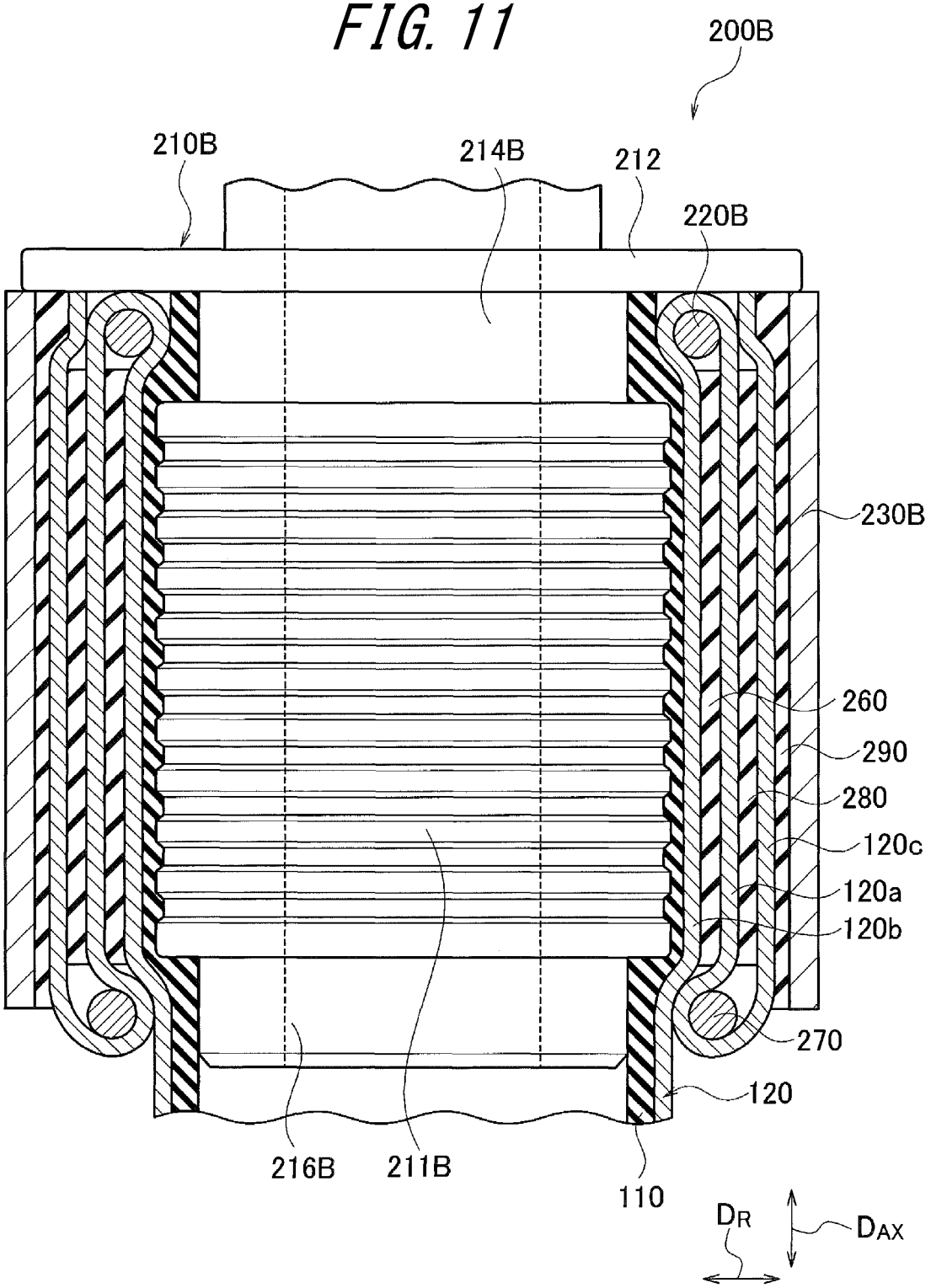
FIG. 11 is a partial sectional view of the hydraulic actuator 10 including a sealing mechanism 200B, cut along the axis direction $D_{AX}$ of the hydraulic actuator, according to Embodiment 3-1.

FIG. 11 is a partial sectional view of the hydraulic actuator 10 including a sealing mechanism 200B, cut along the axis direction $D_{AX}$ of the hydraulic actuator, according to Embodiment 3-1. Embodiment 3-1 and Embodiment 3-2 employ two locking rings.

The sealing mechanism 200B includes a sealing member 210B, a first locking ring 220B, a caulking member 230B, and a second locking ring 270, as shown in FIG. 11.

The sealing mechanism 200B includes the second locking ring 270, as well as the first locking ring 220B, as described above. The second locking ring 270 fixedly holds the sleeve 120 at a position on the outer side in the radial direction $D_R$ of a trunk portion 211B and closer to the center in the axis direction $D_{AX}$ of the actuator main body 100 than the first locking ring 220B.

Specifically, the sealing member 210B has a second small diameter portion 216B, of which outer diameter is smaller than that of the trunk portion 211B.

The second locking ring 270 is provided on the outer side in the radial direction $D_R$ of the second small diameter portion 216B. The inner diameter of the second locking ring 270 is preferably smaller than the outer diameter of the trunk portion 211B. The outer diameter of the second locking ring 270 may also be smaller than the outer diameter of the trunk portion 211B. Due to this structure, the second locking ring 270 is fixedly engaged with the second small diameter portion 216B.

The sleeve 120 has a second folded-back portion 120*c*, which has been folded forward by way of the second locking ring 270. The second folded-back portion 120*c* is continuous with the first folded-back portion 120*a*. Specifically, the second folded-back portion 120*c* is folded forward at an end in the axis direction $D_{AX}$ of the first folded-back portion 120*a* to be disposed on the outer peripheral side of the first folded-back portion 120*a*.

More specifically, the sleeve 120, folded toward the center side in the axis direction $D_{AX}$ of the actuator main body 100 by way of the first locking ring 220B, forms the first folded-back portion 120*a*. The first folded-back portion 120*a* of the sleeve 120 is then folded on the side of the end portion in the axis direction $D_{AX}$ of the actuator main body 100, thereby forming the second folded-back portion 120*c*.

The caulking member 230B caulks the tube 110 having the trunk portion 211B inserted therein, the sleeve main body 120*b* situated on the outer side in the radial direction $D_R$ of the tube 110, the first folded-back portion 120*a*, and the second folded-back portion 120*c* in collaboration with the sealing member 210B.

The rubber sheet 260 is provided between the sleeve main body 120*b* and the first folded-back portion 120*a*, as in Embodiment 1-3.

Further, a sheet-like elastic member is provided between the first folded-back portion 120*a* and the second folded-back portion 120*c*, as well. Specifically, a rubber sheet 280 is provided between the first folded-back portion 120*a* and the second folded-back portion 120*c*. The rubber sheet 280 is provided so as to cover an outer peripheral surface of the cylindrical first folded-back portion 120*a*.

Yet further, a rubber sheet 290 having a configuration similar to that of the rubber sheet 250 of Embodiment 1-3 is provided between the second folded-back portion 120*c* and the caulking member 230B. The rubber sheet 290 is provided so as to cover an outer peripheral surface of the cylindrical second folded-back portion 120*c*.

(2.8) Embodiment 3-2

Figure 12:
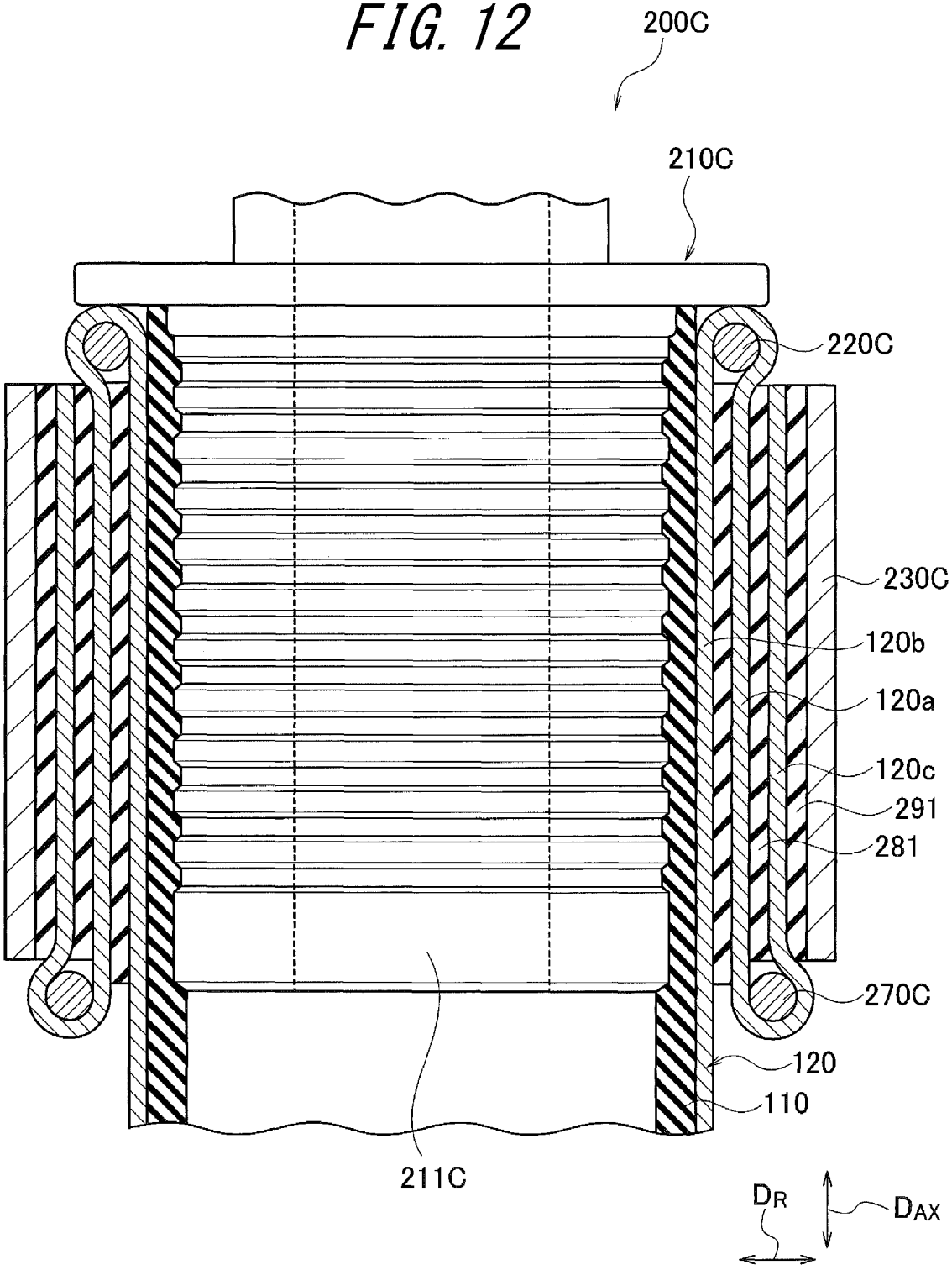
FIG. 12 is a partial sectional view of the hydraulic actuator 10 including a sealing mechanism 200C, cut along the axis direction $D_{AX}$ of the hydraulic actuator, according to Embodiment 3-2.

FIG. 12 is a partial sectional view of the hydraulic actuator 10 including a sealing mechanism 200C, cut along the axis direction $D_{AX}$ of the hydraulic actuator, according to Embodiment 3-2. Hereinafter, Embodiment 3-2 will be described mainly in regard to differences between Embodiment 3-1 and itself.

Embodiment 3-2 employs a sealing member 210C in which neither the first small diameter portion 214B nor the second small diameter portion 216B is formed.

The sealing member 210C has a trunk portion 211C. Since neither the first small diameter portion 214B nor the second small diameter portion 216B of the sealing member 210B is formed in the sealing member 210C, the inner diameter of the first locking ring 220C and the inner diameter of the second locking ring 270C are larger than the outer diameter of the trunk portion 211C, respectively.

The caulking member 230C is positioned between the first locking ring 220C and the second locking ring 270C in the axis direction $D_{AX}$. Accordingly, the first locking ring 220C and the second locking ring 270C are exposed to the exterior at the portions thereof on which the sleeve 120 is folded backward/forward.

Further, a rubber sheet 281 having a configuration similar to that of the rubber sheet 280 of Embodiment 3-1 is provided between the first folded-back portion 120*a* and the second folded-back portion 120*c*. Yet further, a rubber sheet 291 having a configuration similar to that of the rubber sheet 290 of Embodiment 3-1 is provided between the second folded-back portion 120*c* of the sleeve 120 and the caulking member 230C.

EXAMPLES

The present disclosure will be described further in detail by Examples hereinafter. The present disclosure is not limited by any means to these Examples.

(Preparation of Tube)

A rubber composition was prepared by mixing and kneading the following components by a Banbury mixer.

High nitrile NBR (acrylonitrile-butadiene rubber, "N220S", manufactured by JSR Corporation): 45 parts by mass Intermediate-high nitrile NBR (acrylonitrile-butadiene rubber, "N230S", manufactured by JSR Corporation): 35 parts by mass BR (butadiene rubber, "UBEPOL® BR150", manufactured by Ube Industries, Ltd.): 20 parts by mass Carbon black ("SEAST 3", manufactured by Tokai Carbon Co., Ltd.): 50 parts by mass Stearic acid ("STEARIC ACID 50S", manufactured by New Japan Chemical Co., Ltd.): 1 part by mass Anti-oxidant ("Nocrac 6C", manufactured by Ouchi Shiko Chemical Industrial Co., Ltd.): 2 parts by mass Resin ("Quintone 100", manufactured by Zeon Corporation): 10 parts by mass Plasticizer ("SANSO CIZER DOA", manufactured by New Japan Chemical Co., Ltd.): 8 parts by mass Zinc white (ZnO, "Zinc White No. 3", manufactured by Hakusui Tech Co., Ltd.): 5 parts by mass Sulfur ("Sulfax Z", manufactured by Tsurumi Chemical Industry Co., Ltd.): 1 part by mass Vulcanization accelerator CBS ("Nocceler CZ", manufactured by Ouchi Shiko Chemical Industrial Co., Ltd.): 1 part by mass Vulcanization accelerator TOT ("Nocceler TOT-N", manufactured by Ouchi Shiko Chemical Industrial Co., Ltd.): 2 parts by mass Test tubes each having a cylindrical configuration (length: 300 mm) were prepared by processing the rubber composition thus obtained, by an extrusion molding machine, respectively. The outer diameter and thickness of each of the test tubes thus prepared are shown in Table 1.

(Preparation of Sleeve)

Test sleeves each having a cylindrical, woven structure were prepared by weaving 64 cords made of aramid fibers having characteristics shown in Table 1, respectively. Each of the aramid fiber cords was prepared by subjecting the aramid fibers as raw yarns to first twist and then second twist. Accordingly, each test sleeve had a cylindrical, woven structure wherein 64 cords made of the aramid fibers were observed along a circumference of a cross section thereof.

Specifically, each test sleeve had a cylindrical, woven structure constituted of one group of 32 aramid fiber cords disposed in parallel to each other at equal intervals therebetween to collectively form a spiral configuration and the other group of 32 aramid fiber cords disposed in parallel to each other at equal intervals therebetween to collectively form another spiral configuration so as to intersect the one group of 32 aramid fiber cords. The one group of 32 aramid fiber cords and the other group of 32 aramid fiber cords were woven to intersect each other alternately. More specifically, the test sleeve was formed so that pairs of the two intersecting points at which pairs of the cords intersect one cord at the upper/lower side thereof in an alternate manner are shifted by a single cord, in terms of the intersecting points, from pairs of the two intersecting points at which pairs of the cords intersect another cord (adjacent to the one cord) at the upper/lower side thereof in an alternate manner, as shown in FIG. 3A. That is, the test sleeve was woven by a twill weave.

The relevant characteristics of each test sleeve, as well as those of the cords constituting the test sleeve, are shown in Table 1.

(Preparation of Actuator)

Test actuators each having the structures shown in FIGS. 1 and 2 were prepared by using the test tubes and the test woven sleeves described above, respectively. "UF46" of COSMO SUPER EPOCH was used as hydraulic oil for the tube integrated in the actuator. The angles of the cords constituting of the sleeve of each test actuator thus prepared, as well as durability of the test actuator, were evaluated by the methods described below, respectively.

<Method for Evaluating Angle Formed by Cord Constituting Sleeve>

The angle formed by the cord constituting the sleeve with respect to the axis direction of the actuator was determined as described below, i.e. by:

(1) photographing a relevant portion of the actuator;

(2) selecting an image of the middle portion of the actuator (the portion where the image is well focused and the satisfactory image quality for analysis is ensured, the portion corresponding to a region where a decrease in diameter of the sleeve is within 5% with respect to the largest diameter of the sleeve);

(3) measuring, in the image of the middle portion thus selected, angles formed by the cords constituting the sleeve with respect to the axis direction centerline of the sealing mechanism; and (4) calculating the average of five values of angles thus measured, and regarding the average as a measurement value.

The aforementioned angle was measured for each test actuator in a state of no load and no pressure applied to the actuator and a contracting state with predetermined load and hydraulic pressure (internal pressure) applied thereon, respectively. In Table 1, the angle in the state of no load and no pressure applied to the actuator is indicated as "Initial cord angle $\Theta_1$" and the angle in the contracting state with predetermined load and hydraulic pressure applied thereon is indicated as "Contracting-state cord angle $\Theta_2$".

<Method for Evaluating the Total Area (S2) of Clearances Between Cords Constituting Sleeve>

The total area (S2) of clearances between the cords was determined by a photographic analysis in a manner similar to that of <Method for evaluating angle formed by cord constituting sleeve> described above, while adjusting load applied to the actuator such that the average angle formed by the cords of the sleeve with respect to the axis direction of the actuator under the hydraulic pressure of 5 MPa was set to be 45°. Then, a ratio (S2/S1) of the total area (S2) thus determined, with respect to an area (S1) of an outer peripheral surface of the actuator main body, was calculated. The ratio is indicated as "Contracting-state clearance rate (S2/S1)" in Table 1, ±1° was allowed as a margin of error in the actual measurement of angles of the cords.

<Method for Evaluating Durability of Actuator>

Durability of the test actuator was determined by: injecting the hydraulic oil into the tube and completely substituting air in the tube with the hydraulic oil; then controlling injection of the hydraulic oil such that the pressure of the hydraulic oil in the tube reciprocally changes between 0 MPa and 5 MPa in an alternate and repetitive manner at every 3 second; counting the number of injections until cracks were generated in the tube and the actuator could no longer function; and expressing the count number as an index value relative to the count number of Example 1 being "100". The larger index value represents the higher durability.

Further, the state of malfunction/dysfunction of the broken actuator was observed and evaluated according to the criteria shown below.

A: Malfunction/dysfunction of the actuator due to damage on the tube at a portion thereof in direct contact with the cord B: Malfunction/dysfunction of the actuator due to damage on the tube at a portion thereof not in direct contact with the cord C: Malfunction/dysfunction of the actuator due to breakage of the cord.

TABLE 1

| | | | Example 1 | Example 2 | Example 3 | Example 4 | Example 5 |
|---|---|---|---|---|---|---|---|
| Tube | Outer diameter of tube | mm | 13.0 | 13.0 | 13.0 | 13.0 | 13.0 |
| | Thickness (t) of tube | mm | 2 | 2.2 | 2 | 2.2 | 2.2 |
| Sleeve | Initial cord angle $\Theta_1$ (under no load and no pressure) | degree | 25 | 25 | 25 | 25 | 25 |
| | Contracting-state clearance rate (S2/S1) | % | 31.9 | 11.1 | 26.8 | 8.7 | 18.8 |
| | Contracting-state cord angle $\Theta_2$ | degree | 53.1 | 52.3 | 51.3 | 51.2 | 51.9 |
| | Diameter (d) of cord | mm | 0.51 | 0.71 | 0.47 | 0.71 | 0.71 |
| | Right side of formula (1) | mm | 0.68 | 0.67 | 0.66 | 0.66 | 0.67 |
| | Right side of formula (2) | mm | 1.82 | 2.01 | 1.77 | 2.01 | 2.01 |
| | Inner diameter of sleeve | mm | 14.1 | 14.1 | 14.1 | 14.1 | 14.1 |
| | Fineness (D) of raw yarn | dtex | 2200 | 2200 | 1100 | 2200 | 2200 |
| | Density (ρ) of raw yarn | $g/cm^3$ | 1.44 | 1.44 | 1.44 | 1.44 | 1.44 |
| | First twist number $T_1$ of cord | number/10 cm | 28 | 12 | 15 | 12 | 12 |
| | Second twist number $T_2$ of cord | number/10 cm | 28 | 12 | 15 | 12 | 12 |
| | The number of the twisted yarns | number/cord | 2 | 2 | 2 | 2 | 2 |

TABLE 1-continued

| | | | | | | | |
|---|---|---|---|---|---|---|---|
| | Twist coefficient K of cord | — | 0.387 | 0.166 | 0.147 | 0.166 | 0.166 |
| | $T_1/D$ | — | 0.013 | 0.005 | 0.014 | 0.005 | 0.005 |
| | $T_1/T_2$ | — | 1.0 | 1.0 | 1.0 | 1.0 | 1.0 |
| | Breaking strength of cord | N/cord | 615 | 633 | 340 | 633 | 633 |
| | Breaking elongation of cord | % | 5.2 | 4.9 | 4.8 | 4.9 | 4.9 |
| | Driving density of cords in sleeve | number/cm | 15.6 | 15.6 | 23.3 | 15.6 | 11.7 |
| | Type of cord weaving | — | Twill weave | Twill weave | Twill weave | Twill weave | Twill weave |
| Evaluation | Durability | Index | 100 | 313 | 215 | 575 | 488 |
| | State of malfunction/dysfunction | — | A | A | A | A | A |

| | | | Example 6 | Comp. Ex. 1 | Comp. Ex. 2 | Comp. Ex. 3 |
|---|---|---|---|---|---|---|
| Tube | Outer diameter of tube | mm | 13.0 | 13.0 | 13.0 | 13.0 |
| | Thickness (t) of tube | mm | 2.2 | 2 | 2 | 2 |
| Sleeve | Initial cord angle $\Theta_1$ (under no load and no pressure) | degree | 25 | 25 | 25 | 25 |
| | Contracting-state clearance rate (S2/S1) | % | 16.4 | 35.2 | 47.4 | 42 |
| | Contracting-state cord angle $\Theta_2$ | degree | 51.0 | 53.0 | 52.1 | 52.9 |
| | Diameter (d) of cord | mm | 0.83 | 0.51 | 0.33 | 0.56 |
| | Right side of formula (1) | mm | 0.66 | 0.68 | 0.67 | 0.68 |
| | Right side of formula (2) | mm | 2.13 | 1.82 | 1.63 | 1.87 |
| | Inner diameter of sleeve | mm | 14.1 | 14.1 | 14.1 | 14.1 |
| | Fineness (D) of raw yarn | dtex | 3600 | 2200 | 1100 | 1100 |
| | Density (ρ) of raw yarn | $g/cm^3$ | 1.44 | 1.44 | 1.44 | 1.44 |
| | First twist number $T_1$ of cord | number/10 cm | 28 | 28 | 36 | 58 |
| | Second twist number $T_2$ of cord | number/10 cm | 28 | 28 | 36 | 52 |
| | The number of the twisted yarns | number/cord | 2 | 2 | 2 | 2 |
| | Twist coefficient K of cord | — | 0.495 | 0.387 | 0.352 | 0.508 |
| | $T_1/D$ | — | 0.008 | 0.013 | 0.033 | 0.053 |
| | $T_1/T_2$ | — | 1.0 | 1.0 | 1.0 | 1.1 |
| | Breaking strength of cord | N/cord | 918 | 615 | 312 | 254 |
| | Breaking elongation of cord | % | 4.6 | 5.2 | 4.5 | 6.2 |
| | Driving density of cords in sleeve | number/cm | 11.7 | 11.7 | 11.7 | 15.6 |
| | Type of cord weaving | — | Twill weave | Twill weave | Twill weave | Twill weave |
| Evaluation | Durability | Index | 538 | 63 | 25 | 22 |
| | State of malfunction/dysfunction | — | A | B | C | A |

It is understood from Table 1 that the hydraulic actuator according to the present disclosure has high durability.

REFERENCE SIGNS LIST

10: Hydraulic actuator
20: Connection portion
100: Actuator main body
110: Tube
120: Sleeve
120*a*: First folded-back portion
120*b*: Sleeve main body
120*c*: Second folded-back portion
121: Cord
121A, 121B: Cord groups
122: Clearance between cords
200, 200A, 200B, 200C: Sealing mechanism
210, 210A, 210B, 210C: Sealing member
211, 211A, 211B, 211C: Trunk portion
212, 212A: Flange portion
213: Irregular portions
214, 214B: First small diameter portion
215: Passage hole
216B: Second small diameter portion
220, 220A, 220B, 220C: First locking ring
230, 230A, 230B, 230C: Caulking member
231: Indentation
240: Adhesive layer
250, 250A: Rubber sheet
260: Rubber sheet
270, 270C: Second locking ring
280, 281: Rubber sheet
290, 291: Rubber sheet
300: Sealing mechanism
400, 500: Fitting
410, 510: Passage hole
$D_{AX}$: Axis direction
$D_R$: Radial direction

The invention claimed is:

1. A hydraulic actuator, having an actuator main body constituted of a cylindrical tube capable of expanding/contracting by hydraulic pressure and a sleeve for covering an outer peripheral surface of the tube, the sleeve having a cylindrical structure formed by cords woven to be disposed in predetermined directions, wherein:

the average angle formed by the cords of the sleeve with respect to the axis direction of the actuator with no load and no pressure applied thereon is in a range of 20° or larger and less than 45°; and in a state where the average angle formed by the cords of the sleeve with respect to the axis direction of the actuator is 45° under hydraulic pressure of 5 MPa, a ratio (S2/S1) of the total area (S2) of clearances between the cords of the sleeve with respect to an area (S1) of an outer peripheral surface of the actuator main body is 35% or less.

2. The hydraulic actuator of claim 1, wherein the cords which form the sleeve is made of at least one fiber material selected from the group consisting of polyamide fiber, polyester fiber, polyurethane fiber, rayon, acrylic fiber, and polyolefin fiber.

3. The hydraulic actuator of claim 2, wherein the sleeve is made of one group of cords disposed in one direction and the other group of cords disposed to intersect the cords of the one group, so that the intersecting points at which the cords or pairs of the cords intersect one cord at the upper/lower side thereof in an alternate manner are shifted, by a single cord, from the intersecting points at which the cords or pairs of the cords intersect another cord, adjacent to the one cord, at the upper/lower side thereof in an alternate manner.

4. The hydraulic actuator of claim 2, wherein the sleeve is woven by a twill or plain weave.

5. The hydraulic actuator of claim 2, wherein the cords of the sleeve have breaking strength of at least 200 N/one cord.

6. The hydraulic actuator of claim 2, wherein the cords of the sleeve each have breaking elongation of at least 2.0%.

7. The hydraulic actuator of claim 2, wherein each of the cords of the sleeve has a diameter in the range of 0.3 mm to 1.5 mm.

8. The hydraulic actuator of claim 1, wherein the sleeve is made of one group of cords disposed in one direction and the other group of cords disposed to intersect the cords of the one group, so that the intersecting points at which the cords or pairs of the cords intersect one cord at the upper/lower side thereof in an alternate manner are shifted, by a single cord, from the intersecting points at which the cords or pairs of the cords intersect another cord, adjacent to the one cord, at the upper/lower side thereof in an alternate manner.

9. The hydraulic actuator of claim 1, wherein the sleeve is woven by a twill or plain weave.

10. The hydraulic actuator of claim 1, wherein the cords of the sleeve have breaking strength of at least 200 N/one cord.

11. The hydraulic actuator of claim 1, wherein the cords of the sleeve each have breaking elongation of at least 2.0%.

12. The hydraulic actuator of claim 1, wherein each of the cords of the sleeve has a diameter in the range of 0.3 mm to 1.5 mm.

13. The hydraulic actuator of claim 1, wherein driving density of the cords in the sleeve is in the range of 6.8 cords/cm to 25.5 cords/cm.

14. The hydraulic actuator of claim 1, wherein, provided that "t" (mm) represents thickness of the tube, "d" (mm) represents a diameter of the cord of the sleeve, "$\Theta_1$" represents the average angle formed by the cord of the sleeve with respect to the axis direction of the actuator with no load and no pressure applied thereon, and "$\Theta_2$" represents the average angle formed by the cord of the sleeve with respect to the axis direction of the actuator in an actuator contracting state, t, d, $\Theta_1$ and $\Theta_2$ satisfy general formula (1) shown below:

$$t > \sin\Theta_2 \cdot \frac{\sin(2\Theta_2)}{\sin(2\Theta_1)} \cdot \left(\frac{1}{\sin(2\Theta_1)} - \frac{1}{2\cos\Theta_2}\right) \cdot d. \quad (1)$$

15. The hydraulic actuator of claim 14, wherein, provided that "t" (mm) represents thickness of the tube, "d" (mm) represents a diameter of the cord of the sleeve, "$\Theta_1$" represents the average angle formed by the cord of the sleeve with respect to the axis direction of the actuator with no load and no pressure applied thereon, and "$\Theta_2$" represents the average angle formed by the cord of the sleeve with respect to the axis direction of the actuator in the actuator contracting state, t, d, $\Theta_1$ and $\Theta_2$ satisfy general formula (2) shown below:

$$t > \frac{\sin(2\Theta_2)\sin(\Theta_2)}{\sin^2(2\Theta_1)} \cdot d. \quad (2)$$

16. The hydraulic actuator of claim 1, wherein twist coefficient K of the cord of the sleeve, defined by general formula (3) shown below, is in the range of 0.14 to 0.50

$$K = T_2 \times \sqrt{0.125 \times \frac{D}{\rho}} \times 10^{-3}. \quad (3)$$

[In the formula (3), "$T_2$" represents the second twist (number/10 cm) of the cord, $T_2$ should be replaced with the first twist number $T_1$ (number/10 cm) when the cord is a single twist cord, "D" represents the fineness per one raw yarn (dtex) of the cord, and "ρ" represents the density (g/cm$^3$) of the yarn of the cord].

17. The hydraulic actuator of claim 1, wherein the cord of the sleeve has a ratio ($T_1$/D) of the first twist number $T_1$ (number/10 cm) with respect to the fineness D (dtex) per one raw yarn of the cord in the range of 0.004 to 0.03.

18. The hydraulic actuator of claim 1, wherein the cord of the sleeve has a ratio ($T_1/T_2$) of the first twist number $T_1$ (number/10 cm) with respect to the second twist number $T_2$ (number/10 cm) in the range of 0.8 to 1.2.

19. The hydraulic actuator of claim 1, wherein: the fineness D per one raw yarn of the cord of the sleeve is in the range of 800 to 5000 dtex; and the cord has the first twist number $T_1$ in the range of 3.2 to 150/10 cm, the second twist number $T_2$ in the range of 2.6 to 180/10 cm, and the number of the twisted yarns constituting the cord in the range of 2 to 4.

20. The hydraulic actuator of claim 1, wherein thickness of the tube with no load and no pressure applied on the actuator is in the range of 1.0 mm to 6.0 mm.

* * * * *